US006672586B2

(12) United States Patent
Murata et al.

(10) Patent No.: US 6,672,586 B2
(45) Date of Patent: Jan. 6, 2004

(54) SHEET PROCESSING APPARATUS AND METHOD OF CONTROLLING SAME, SHEET PROCESSING METHOD, AND STORAGE MEDIA THEREFOR

(75) Inventors: Mitsushige Murata, Ohta-ku (JP); Norifumi Miyake, Ohta-ku (JP); Kiyoshi Okamoto, Ohta-ku (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 10/166,023

(22) Filed: Jun. 10, 2002

(65) Prior Publication Data

US 2003/0006548 A1 Jan. 9, 2003

Related U.S. Application Data

(63) Continuation of application No. 09/624,617, filed on Jul. 24, 2000, now abandoned.

(30) Foreign Application Priority Data

Jul. 23, 1999 (JP) ..... 11-209155

(51) Int. Cl.[7] ..... B65H 7/00

(52) U.S. Cl. ..... 271/256; 271/258.01; 271/176

(58) Field of Search ..... 271/256, 258.01, 271/176, 288, 298, 301

(56) References Cited

U.S. PATENT DOCUMENTS 5,105,229 A * 4/1992 Ozaki
6,102,393 A * 8/2000 Kida et al. ..... 271/176 X
6,142,469 A * 11/2000 Nanba et al. ..... 271/176 X
6,264,189 B1 * 7/2001 Kawata ..... 271/176

FOREIGN PATENT DOCUMENTS

JP 10-279166 10/1998

* cited by examiner

*Primary Examiner*—David H. Bollinger
(74) *Attorney, Agent, or Firm*—Rossi & Associates

(57) ABSTRACT

A sheet processing apparatus is provided, which is capable of achieving high quality processing and maintaining high productivity without giving rise to problems such as sheet jam or damage of sheets even when various sheets having different attributes are conveyed. A buffer roller 505 is inhibited from carrying out a sheet staying operation in accordance with the type of sheets conveyed from an upstream side of the apparatus, to be conveyed to a downstream side of the apparatus via the buffer roller 505.

22 Claims, 18 Drawing Sheets

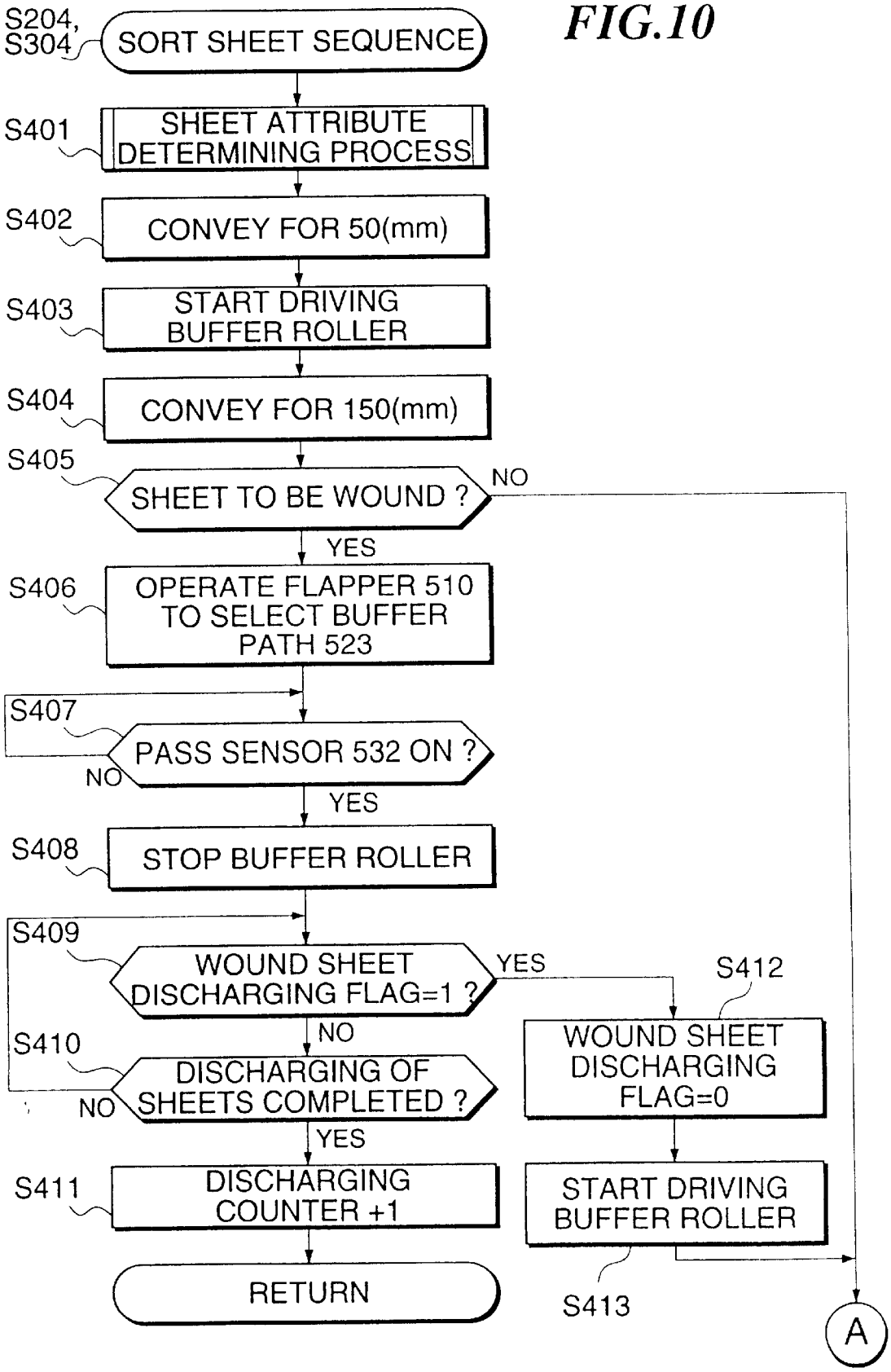
FIG.10
S204, S304
SORT SHEET SEQUENCE
S401
SHEET ATTRIBUTE DETERMINING PROCESS
S402
CONVEY FOR 50(mm)
S403
START DRIVING BUFFER ROLLER
S404
CONVEY FOR 150(mm)
S405
SHEET TO BE WOUND ?
NO
YES
S406
OPERATE FLAPPER 510 TO SELECT BUFFER PATH 523
S407
PASS SENSOR 532 ON ?
NO
YES
S408
STOP BUFFER ROLLER
S409
WOUND SHEET DISCHARGING FLAG=1 ?
YES
NO
S412
WOUND SHEET DISCHARGING FLAG=0
S410
DISCHARGING OF SHEETS COMPLETED ?
NO
YES
S411
DISCHARGING COUNTER +1
START DRIVING BUFFER ROLLER
S413
RETURN
A

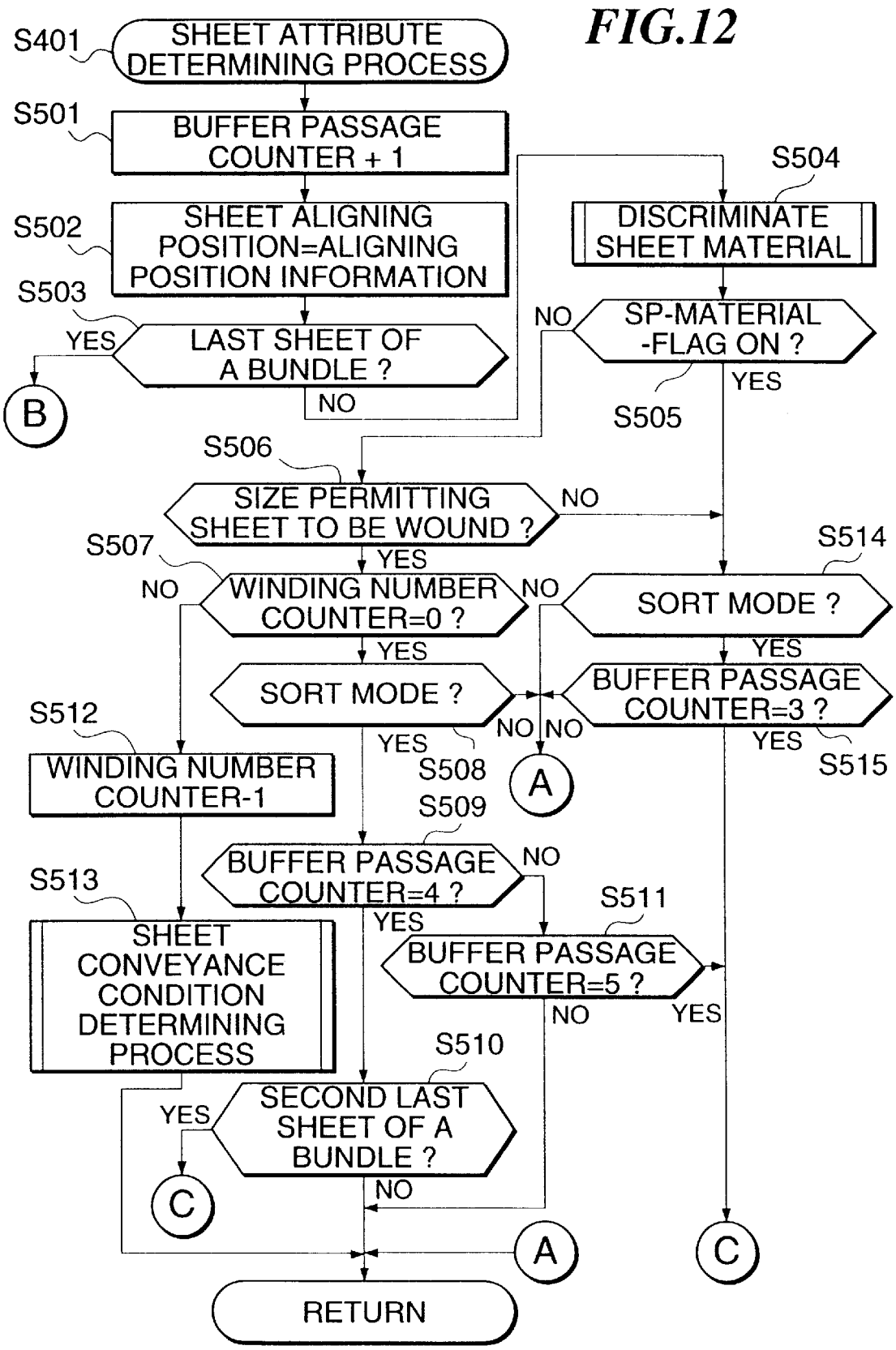
FIG.12
S401
SHEET ATTRIBUTE DETERMINING PROCESS
S501
BUFFER PASSAGE COUNTER + 1
S502
SHEET ALIGNING POSITION=ALIGNING POSITION INFORMATION
S503
LAST SHEET OF A BUNDLE ?
YES
NO
B
S504
DISCRIMINATE SHEET MATERIAL
SP-MATERIAL -FLAG ON ?
NO
YES
S505
S506
SIZE PERMITTING SHEET TO BE WOUND ?
NO
YES
S507
WINDING NUMBER COUNTER=0 ?
NO
YES
SORT MODE ?
NO
YES
S508
S509
BUFFER PASSAGE COUNTER=4 ?
NO
YES
S510
SECOND LAST SHEET OF A BUNDLE ?
YES
NO
C
S511
BUFFER PASSAGE COUNTER=5 ?
NO
YES
S512
WINDING NUMBER COUNTER-1
S513
SHEET CONVEYANCE CONDITION DETERMINING PROCESS
S514
SORT MODE ?
YES
BUFFER PASSAGE COUNTER=3 ?
NO
YES
S515
A
A
C
RETURN

SHEET PROCESSING APPARATUS AND METHOD OF CONTROLLING SAME, SHEET PROCESSING METHOD, AND STORAGE MEDIA THEREFOR

CROSS REFERENCE TO RELATED APPLICATION Ser. No. 09/624,617

This is a Continuation of application Ser. No. 09/624,617 filed Jul. 24, 2000 now abandoned.

BACKGROUND OF THE INVENTION

1. Field of the Invention

The present invention relates to a sheet processing apparatus for conveying and processing sheets and a method of controlling the same, a sheet processing method, and storage media therefor.

2. Description of the Prior Art

In a conventional sheet processing apparatus that performs processing operations such as conveyance, stacking, sort and so forth, upon sheets discharged from an image forming apparatus or the like, in order to avoid a degradation in the overall processing efficiency of relatively time-consuming sheet processing operations on a downstream side of the apparatus as best represented by a binding operation upon a sheet bundle, recently, it has been proposed to provide a turnout for storing sheets in the conveyance path where the conveyance of sheets is temporarily stayed so that a plurality of sheets consisting of the stored sheets and other sheets subsequently conveyed from an upstream side of the apparatus are conveyed together simultaneously. In this way, an ample time can be secured for processing sheets on the downstream side, to thereby avoid degraded overall processing efficiency.

However, when special sheets such as cover sheets, thick paper sheets, thin paper sheets, tabbed sheets, colored sheets or other sheets that have different attributes from those of ordinary sheets are conveyed from an inserter to the turnout, these different attributes give rise to various problems. In the case of thick paper sheets, for example, the gap of the conveyance path may be narrowed due to the thickness of the sheets, or the thick paper sheet(s) may be pushed at the turnout to become curled and this curling deformation in turn may make the sheet(s) further thicker and further narrow the gap of the conveyance path, leading to an increase of the conveyance load and eventually giving rise to a paper jam. In the case of colored sheets, for example, the colored sheets may also be deformed into a curled shape and may narrow the gap between the sheets and conveyance path at the turnout or in subsequent discharge of the sheets. As a result, conveyance rollers and the like are forced to exert a strong conveyance load on the sheets so that traces of the rollers may be formed on the colored sheets.

SUMMARY OF THE INVENTION

It is an object of the present invention to provide a sheet processing apparatus and a method of controlling the same, a sheet processing method, and storage media therefor, which overcome the above described problems.

It is an object of the present invention to provide a sheet processing apparatus and a method of controlling the same, a sheet processing method, and storage media therefor, which are capable of achieving high quality processing and maintaining high productivity without giving rise to problems such as sheet jam or damage of sheets even when various sheets having different attributes are conveyed.

To attain the above objects, according to a first aspect of the present invention, there is provided a sheet processing apparatus comprising a conveyance path, a discharging port, conveyance means for conveying sheets along the conveyance path to the discharging port, sheet staying means for temporarily staying the sheets on the conveyance path, sheet type determining means for determining whether each of the sheets conveyed by the conveyance means is a special sheet or not, and sheet staying number limiting means for limiting a number of sheets to be stayed by the sheet staying means when each of the sheets conveyed by the conveyance means is the special sheet.

Preferably, the sheet processing apparatus according to the first aspect further comprises sheet staying number detecting means for detecting a number of sheets stayed by the sheet staying means, and wherein the sheet staying number limiting means comprises determining means for determining based on detection results of the sheet staying number detecting means whether the number of sheets stayed by the sheet staying means has reached a predetermined number that is set in advance in correspondence with the special sheet or not, and control means for causing conveyance of the sheets stayed by the sheet staying means by the conveyance means to be resumed when the number of sheets stayed by the sheet staying means has reached the predetermined number.

Preferably, when each of the sheets conveyed by the conveyance means is the special sheet, the sheet staying number limiting means inhibits staying of the sheets conveyed by the conveyance means by the sheet staying means.

Alternatively, the sheet processing apparatus according to the first aspect further comprises sheet staying number detecting means for detecting the number of sheets stayed by the sheet staying means, and wherein the sheet staying number limiting means comprises determining means for determining based on detection results of the sheet staying number detecting means whether the number of sheets stayed by the sheet staying means has reached a maximum number that is set in advance in correspondence with an ordinary sheet or not, and control means for causing conveyance of the sheets stayed by the sheet staying means by the conveyance means to be resumed when the number of sheets stayed by the sheet staying means has reached the maximum number.

More preferably, the sheet processing apparatus according to the first aspect further comprises sheet position detecting means for detecting a position of each of the sheets on the conveyance path, and wherein the control means temporarily keeps the conveyance means on standby to suspend conveyance of the sheets stayed by the sheet staying means by the conveyance means when the sheet position detecting means detects presence of at least one sheet downstream of the sheet staying means.

In the sheet processing apparatus according to the first aspect, the special sheet is a sheet selected from the group consisting of a sheet from a set tray, a sheet designated as a cover sheet, a sheet designated as a thick paper sheet, a sheet designated as a thin paper sheet, a tabbed sheet, and a colored sheet.

To attain the above objects, according to a second aspect of the present invention, there is provided a sheet processing method for use in a sheet processing apparatus including a conveyance path, a discharging port, conveyance means for conveying sheets along the conveyance path to the discharging port, sheet staying means for temporarily staying the sheets on the conveyance path, the method comprising the steps of determining whether each of the sheets conveyed by the conveyance means is a special sheet or not; and limiting a number of sheets to be stayed by the sheet staying means when each of the sheets conveyed by the conveyance means is the special sheet.

Preferably, in the sheet processing method according to the second aspect, the step of limiting the number of sheets to be stayed by the sheet staying means comprises limiting the number of sheets to be stayed by said sheet staying means by detecting the number of sheets stayed by the sheet staying means, determining whether the number of sheets stayed by the sheet staying means has reached a predetermined number that is set in advance in correspondence with the special sheet or not, and causing conveyance of the stayed sheets to be resumed when the number of sheets stayed by the sheet staying means has reached the predetermined number.

Preferably, the step of limiting the number of sheets to be stayed by the sheet staying means comprises limiting the number of sheets to be stayed by said sheet staying means by inhibiting staying of the sheets conveyed by the conveyance means by the sheet staying means when each of the sheets conveyed by the conveyance means is the special sheet.

Alternatively, the sheet processing method according to the second aspect comprises the steps of detecting the number of sheets stayed by the sheet staying means, determining based on detection results of the step of detecting the number of sheets whether the number of sheets stayed by the sheet staying means has reached a maximum number that is set in advance in correspondence with an ordinary sheet or not, and causing conveyance of the sheets stayed by the sheet staying means by the conveyance means to be resumed when the number of sheets stayed by the sheet staying means has reached the maximum number.

Preferably, the sheet processing method according to the second aspect further comprises the steps of detecting a position of each of the sheets on the conveyance path, and keeping the conveyance means on standby to suspend conveyance of the sheets stayed by the sheet staying means by the conveyance means when the step of detecting the position of each of the sheets detects presence of at least one sheet downstream of the sheet staying means.

In the sheet processing method according to the second aspect, the special sheet is a sheet selected from the group consisting of a sheet from a set tray, a sheet designated as a cover sheet, a sheet designated as a thick paper sheet, a sheet designated as a thin paper sheet, a tabbed sheet, and a colored sheet.

To attain the above objects, according to a third aspect of the present invention, there is provided a sheet processing apparatus which conveys a sheet from an upstream side to a downstream side of the apparatus, comprising sheet staying means for executing a sheet staying process to the sheet from the upstream side, to be conveyed to the downstream side, and control means for inhibiting the sheet staying process of the sheet staying means in accordance with a type of the sheet from the upstream side, to be conveyed to the downstream side via the sheet staying means.

Preferably, the control means causes the sheet conveyed from the upstream side to the downstream side via the sheet staying means, without being stayed by the sheet staying means, in accordance with the type of the sheet from the upstream side, to be conveyed to the downstream side via the sheet staying means.

In a typical example of the third aspect, the sheet from the upstream side includes an ordinary recording sheet, and a special recording sheet different in type from the ordinary recording sheet, and wherein the control means permits the sheet staying process of the sheet staying means if the sheet from the upstream side, to be conveyed to the downstream side, is the ordinary recording sheet, and inhibits the sheet staying process of the sheet staying means if the sheet from the upstream side, to be conveyed to the downstream side, is the special recording sheet different in type from the ordinary recording sheet.

Preferably, the special recording sheet includes at least one of a cover sheet, a tabbed sheet, a thick paper sheet, a thin paper sheet, and a colored sheet.

Preferably, the sheet staying means includes a roller capable of having at least one sheet wound thereon.

More preferably, the roller is capable of having a plurality of sheets wound thereon.

Still more preferably, the roller is capable of having the plurality of sheets wound thereon with each sheet being displaced from a preceding one in a direction of conveyance of the sheets.

Preferably, the sheet processing apparatus according to the third aspect conveys the sheet from the upstream side toward a loading means, arranged on the downstream side, for loading the sheets therein.

Preferably, the control means causes the sheet staying process to be executed by the sheet staying means if a sheet of another group, different from the sheet from the upstream side, is already loaded in the loading means.

More preferably, the control means causes the sheet staying means to stay the sheet from the upstream side until the sheet of another group already loaded in the loading means is removed from the loading means, and causes conveyance of the sheet stayed by the sheet staying means to be resumed when the sheet of another group has been removed from the loading means.

Advantageously, the control means inhibits the sheet staying process of the sheet staying means regardless of the type of the sheet from the upstream side, if a sheet of another group, different from the sheet from the upstream side, is not loaded in the loading means.

Also preferably, the sheet staying means is capable of staying a plurality of sheets, and wherein the control means causes conveyance of the sheets stayed by the sheet staying means to the downstream side to be resumed in accordance with a number of the sheets stayed by the sheet staying means.

To attain the above objects, according to a fourth aspect of the present invention, there is provided a sheet processing apparatus which conveys sheets from an upstream side to a downstream side of the apparatus, comprising sheet staying means for executing a sheet staying process to the sheets from the upstream side, to be conveyed to the downstream side, and control means for controlling a number of sheets to be stayed by the sheet staying means in accordance with a type of the sheets from the upstream side, to be conveyed to the downstream side via the sheet staying means.

Preferably, in the sheet processing apparatus according to the fourth aspect, the sheets from the upstream side include an ordinary recording sheet, and a special recording sheet different in type from the ordinary recording sheet, and wherein the control means controls the number of the special recording sheet to be stayed by the sheet staying means to a number less than the number of the ordinary recording sheet to be stayed.

To attain the above objects, according to a fifth aspect of the present invention, there is provided a control method for controlling a sheet processing apparatus which conveys a sheet from an upstream side to a downstream side of the apparatus, and includes sheet staying means for executing a sheet staying process to the sheet from the upstream side, to be conveyed to the downstream side, the method comprising the step of inhibiting the sheet staying process of the sheet staying means in accordance with a type of the sheet from the upstream side, to be conveyed to the downstream side via the sheet staying means.

To attain the above objects, according to a sixth aspect of the present invention, there is provided a machine readable storage medium storing a program for causing a sheet processing apparatus which conveys a sheet from an upstream side to a downstream side, and includes sheet staying means for executing a sheet staying process to the sheet from the upstream side, to be conveyed to the downstream side, to execute the step of inhibiting the sheet staying process of the sheet staying means in accordance with a type of the sheet from the upstream side, to be conveyed to the downstream side via the sheet staying means.

To attain the above objects, according to a seventh aspect of the present invention, there is provided a control method for controlling a sheet processing apparatus which conveys a sheet from an upstream side to a downstream side, and includes sheet staying means for executing a sheet staying process to the sheet from the upstream side, to be conveyed to the downstream side, the method comprising the step of controlling a number of the sheet to be stayed by the sheet staying means in accordance with a type of the sheet from the upstream side, to be conveyed to the downstream side via the sheet staying means.

To attain the above objects, according to an eight aspect of the present invention, there is provided a machine readable storage medium storing a program for causing a sheet processing apparatus which conveys sheets from an upstream side to a downstream side of the apparatus and includes sheet staying means for executing a sheet staying process to the sheet from the upstream side, to be conveyed to the downstream side, to execute the step of controlling a number of the sheet to be stayed by the sheet staying means in accordance with a type of the sheet from the upstream side, to be conveyed to the downstream side via the sheet staying means.

The above and other objects and features of the present invention will become more apparent from the following detailed description taken in conjunction with the accompanying drawings.

BRIEF DESCRIPTION OF THE DRAWINGS

FIG. 10 is a flow chart showing a sort sheet sequence executed in steps S204 and S304 of FIGS. 8 and 9;

FIG. 12 is a flow chart showing a sheet attribute determining process executed in a step S401 of FIG. 10;

DETAILED DESCRIPTION OF THE PREFERRED EMBODIMENT

The present invention will now be described in detail with reference to drawings showing an embodiment thereof.

Figure 1:
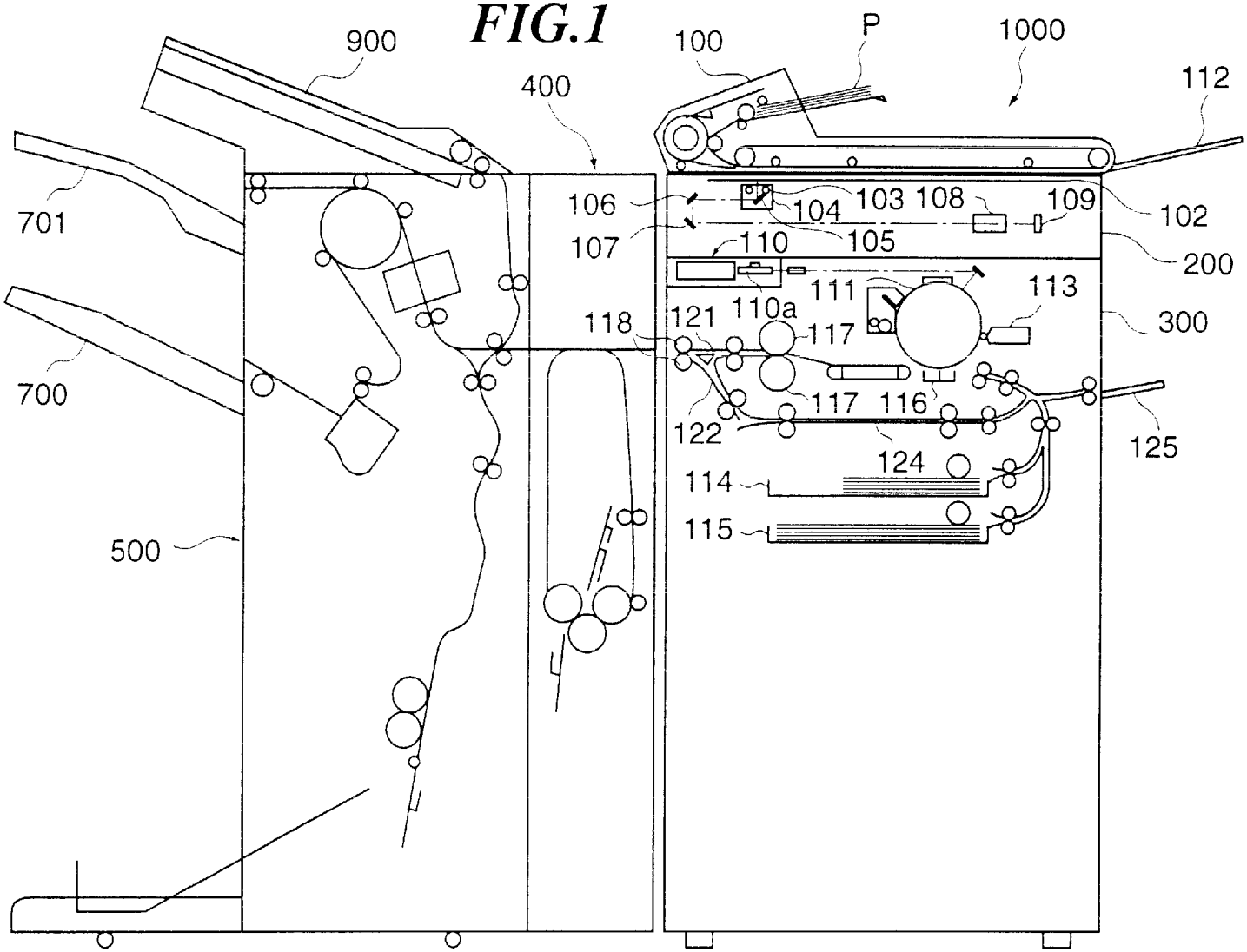
FIG. 1 is a schematic view showing the construction of an image forming apparatus which is equipped with a sheet processing apparatus according to an embodiment of the present invention.

FIG. 1 is a schematic view showing the construction of an image forming apparatus that is equipped with a sheet processing apparatus according to an embodiment of the present invention.

The image forming apparatus 1000 is comprised of an image reader 200 that reads out images of originals, and a printer 300, as shown in FIG. 1. A folding unit 400 and a finisher 500 are mounted on the image forming apparatus 1000.

An original document feeder 100 is mounted on the image reader 200. The original document feeder 100 feeds a set of originals one by one to the left as viewed in FIG. 1, starting with the top-page one of the originals that are set on an original document tray with their front or image formed surfaces facing upward, such that the originals are guided along a curved path to be conveyed from the left onto a platen glass 102, and then through a moving original reading position on the platen glass 102 to the right, and subsequently to an external original discharging tray 112. When the original passes the moving original reading position on the platen glass from left to right, the image of the original is read out by a scanner unit 104 held in a position corresponding to the moving original reading position. This reading method is generally called the moving original reading method. More specifically, when the original passes the moving original reading position, the image formed surface of the original is illuminated by a lamp 103 of the scanner unit 104, and the reflected light from the original is led via mirrors 105, 106, 107 to a lens 108. The light that has passed the lens is focused on the image plane of an image sensor 109.

By thus conveying the original so as to pass the moving original reading position from left to right, scanning is performed to read the original with a direction normal to the conveyance direction of the original as the main scanning direction and the conveyance direction as the subscanning direction. More specifically, as the original passes the moving original reading position, the image of the original is read out line by line in the main scanning direction by the image sensor 109, while the original is conveyed in the subscanning direction. The whole original image is read out in this manner, and the image that has thus been optically read out is converted to image data by the image sensor 109 and output. The image data output from the image sensor 109 is subjected to predetermined processing by an image signal controller 202, described later, and the processed data is entered as a video signal to an exposure control unit 110 of the printer 300.

The original may be stayed at a predetermined position on the platen glass 102 after the original is conveyed onto the platen glass 102 by the original document feeder 100, where the image of the original is read out by causing the scanner unit 104 to scan from left to right. This reading method is the so-called stationary original reading method.

When the original is read without using the original document feeder 100, the original document feeder 100 is first raised by the user and the original is placed on the platen glass 102. Then, the scanner unit 104 is caused to scan from left to right to read out the original. Thus, when the original is read without using the original document feeder 100, the stationary original reading is performed.

The exposure control unit 110 of the printer 300 modulates laser light based on the entered video signal and outputs the modulated laser light. The laser light is projected onto a photosensitive drum 111 to illuminate the same, while being scanned by a polygon mirror 110*a*. An electrostatic latent image corresponding to the scanned laser light is formed on the photosensitive drum 111. The electrostatic latent image on the photosensitive drum 111 is visualized as a toner image by a developer supplied from a developing unit 113. In timing synchronized with the onset of the illumination of the laser light, a sheet is fed from one of cassettes 114, 115, a manual paper feed unit 125 or a double-faced conveyance path 124 and is conveyed into a space between the photosensitive drum 111 and a transfer unit 116. The toner image formed on the photosensitive drum 111 is transferred to the sheet by the transfer unit 116.

The sheet on which the toner image has been transferred is conveyed to a fixing unit 117, and the fixing unit 117 fixes the toner image to the sheet with heat and pressure. The sheet that has passed the fixing unit 117 is conveyed via a flapper 121 and a discharging roller 118 and is discharged from the printer 300 to an external device (folding unit 400).

If the sheet is to be discharged with the image-formed surface facing downward, the sheet that has passed the fixing unit 117 is led by the switching action of the flapper 121 into an inversion path 122, and upon passage of the trailing edge of the sheet through the flapper 121, the sheet is switched back and discharged by the discharging roller 118 from the printer 300. This type of sheet discharging will be hereinafter referred to as the sheet inverted discharging. This sheet inverted discharging is used when image formation is successively performed sheet by sheet starting with the top page, for example, when the original document feeder 100 is used to read out images to be formed, or when an image output from a computer is formed. Then, by sheet inverted discharging, the discharged sheets are stacked in correct order.

When hard sheets such as OHP sheets are fed from a manual paper feed unit 125 to have images formed thereon, the sheets are not led into the inversion path 122, but are discharged by the discharging roller 118 with the image-formed surfaces facing upward.

In the case where duplex recording is selected to form images on both sides of a sheet, the control is performed such that the sheet is led to the inversion path 122 by the switching action of the flapper 121, and is then conveyed to the double-faced conveyance path 124, and the sheet led to the double-faced conveyance path 124 is again fed in the above-mentioned timing to the space between the photosensitive drum 111 and the transfer unit 116.

Figure 2A:
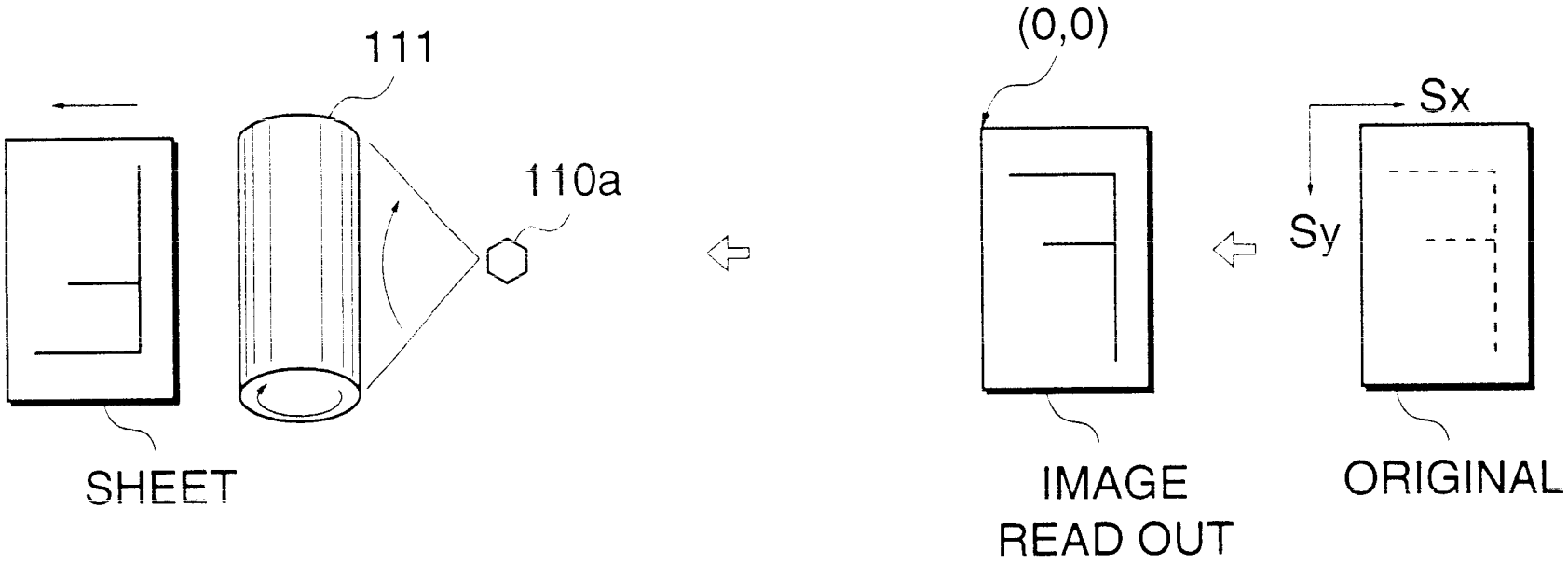
FIG. 2A is a view showing a flow of image formation in a stationary original reading method carried out by the image forming apparatus of FIG. 1.

Next, the image formation process will be explained with reference to FIGS. 2A and 2B for image formation according to the stationary original reading method and image formation according to the moving original reading method. FIG. 2A shows a flow of image formation by the image forming apparatus of FIG. 1, using the stationary original reading method, and FIG. 2B shows a flow of the same using the moving original reading method.

As described above, when a stationary original is read out according to the stationary original reading method, the scanner unit 104 is caused to scan the original image from left to right. More specifically, as shown in FIG. 2A, scanning is performed to read the original image in the main scanning direction Sy and the subscanning direction Sx, so that the image is read out by the image sensor 109. Of the image read out by the image sensor 109, the image components read out in the main scanning direction Sy are successively converted to laser light by the exposure control unit 110, and the laser light is scanned by the polygon mirror 110*a* to form an electrostatic latent image on the photosensitive drum 111. The electrostatic latent image thus formed is then transferred to a sheet, so that an image which is not a mirror image is formed on the sheet.

Figure 2B:
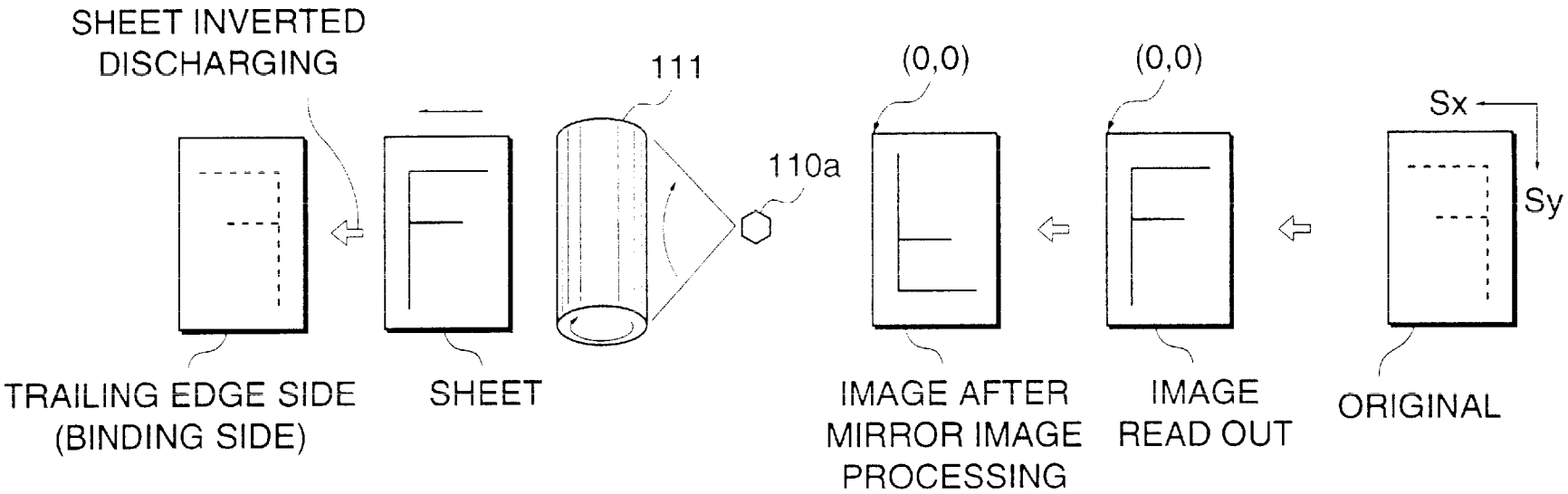
FIG. 2B is a view showing a flow of image formation in a moving original reading method carried out by the image forming apparatus of FIG. 1.

In contrast, when a moving original is read out according to the moving original reading method, as shown in FIG. 2B, scanning is performed on the original image in the main scanning direction Sy and subscanning direction Sx so that the image is read out by the image sensor 109. Here, according to the moving original reading method, the original is conveyed from left to right so that the sense of subscanning direction is opposite to that in the stationary original reading method. Therefore, the image read out by the image sensor 109 is a mirror image of the original image. This mirror image has to be converted to the correct image. Thus, mirror image processing is performed on the image read out by the image sensor 109 to obtain a correct image. In this mirror image processing, the image read out in one sense of the main scanning direction is reversed with respect to the one sense of the main scanning direction. By this mirror image processing, the image read out by the image sensor 109 is converted to a correct image, so that an electrostatic latent image after the mirror image processing is formed on the photosensitive drum 111. When the electrostatic latent image formed in this manner is transferred to a sheet, the correct image (not a mirror image) is formed on the sheet. The sheet with this image formed thereon is discharged by the sheet inverted discharging with the image-formed surface directed downward. The trailing end of the sheet discharged by the sheet inverted discharging corresponds to the left end of the original image. Therefore, as described later, by binding together the trailing or rear ends of the sheets by the finisher 500, the left ends of the sheets with respect to the images will be eventually bound together.

Mirror image processing may be also carried out by reversing the subscanning direction. In this case, however, reading of the image of a whole page needs to be completed before the mirror image processing is performed, and the left ends of the sheets with respect to the images have to be bound together by binding the rear ends of the sheets discharged by sheet inverted discharging. Therefore, the mirror image processing by reversing the main scanning direction is preferable.

The sheet discharged from the printer 300 is fed to the folding unit 400. The folding unit 400 performs a folding operation of folding the sheet in the form of Z. For example, when the sheets have an A3 size or a B4 size and the folding operation is designated, the folding unit 400 performs the folding operation. Otherwise, sheets discharged from the printer 300 are passed through the folding unit 400 as they are, and are fed to the finisher 500. An inserter 900 is provided in the finisher 500 to feed special sheets such as cover sheets and interleaved sheets to be inserted into ordinary sheets having images formed thereon. Book-binding, binding operation, punching and like operations are performed by the finisher 500.

Figure 3:
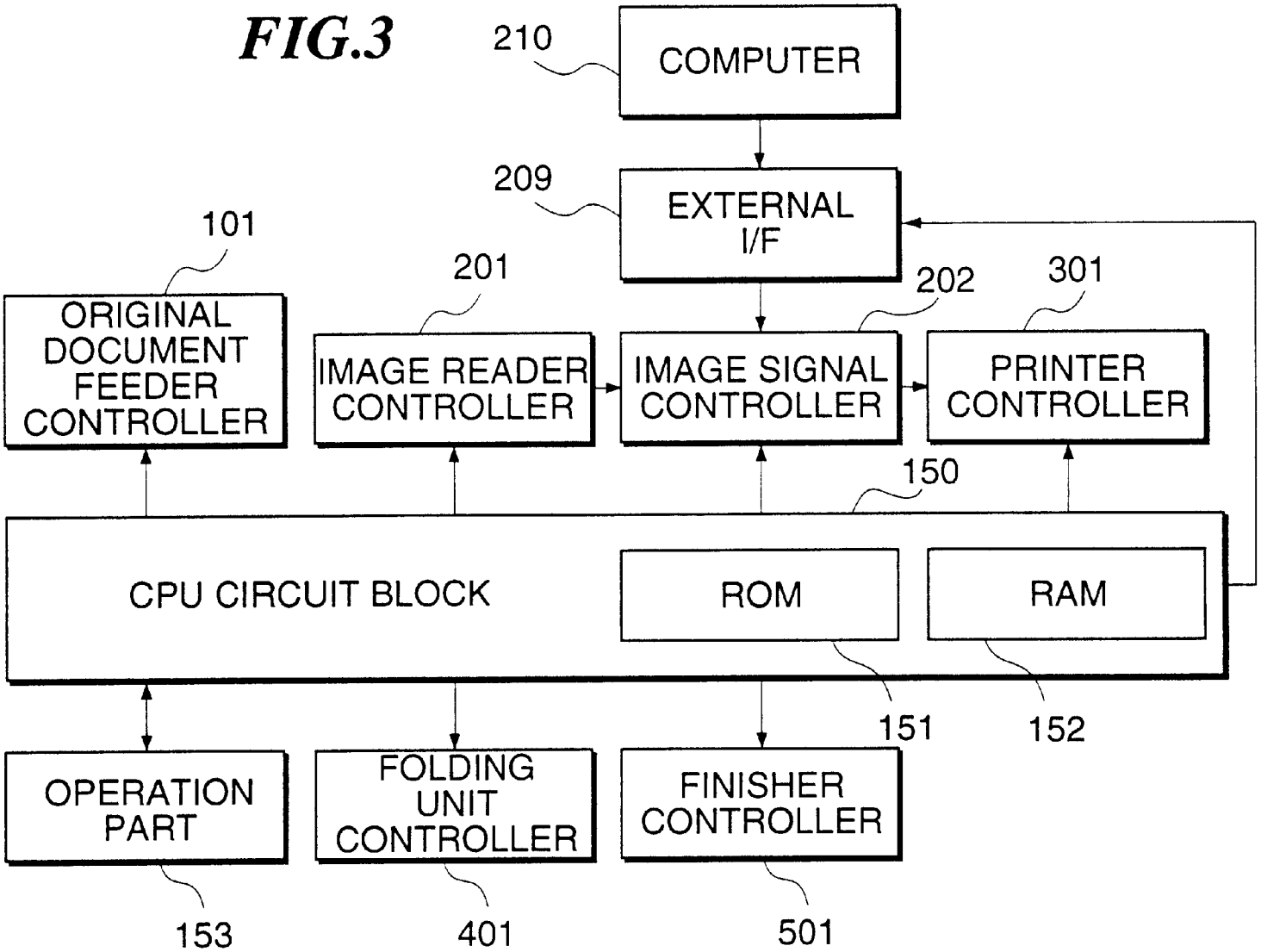
FIG. 3 is a block diagram showing the construction of a controller which controls the overall operation of the image forming apparatus of FIG. 1.

Next, the construction of a controller that controls the entire image forming apparatus will be described with reference to FIG. 3. FIG. 3 is a block diagram showing the construction of the controller.

The controller is comprised of a CPU circuit block 150, as shown in FIG. 3. A CPU circuit block 150 includes a CPU, not shown, a ROM 151, and a RAM 152, and controls all blocks 101, 153, 201, 202, 209, 301, 401, 501 by means of control programs (including programs for executing processes shown in flow charts, etc. to be described later) stored in the ROM 151. The RAM 152 temporarily stores control data, and serves as a work area for operations necessary for the control.

The original document feeder controller 101 controls the operation of the original document feeder 100 based on a command from the CPU circuit block 150. The image reader controller 201 controls the operation of the scanner unit 104, image sensor 109, and others, and delivers an analog image signal output from the image sensor 109 to the image signal controller 202.

The image signal controller 202 first converts the analog image signal from the image sensor 109 into a digital signal and then performs various processing operations on the digital signal, converts this digital signal into a video signal, and outputs the video signal to the printer controller 301. The controller 202 also performs various processing operations on a digital image signal entered via the external I/F 209 from a computer 210, converts this digital signal into a video signal, and outputs it to the printer controller 301. The processing operation of the image signal controller 202 is controlled by the CPU circuit block 150. The printer controller 301 drives the above-mentioned exposure controller 110 based on the input video signal.

An operating part 153 includes a plurality of keys for setting various functions related to image formation, and a display for indicating information indicative of the setting status, outputs a key signal corresponding to an operation of each key to the CPU circuit block 150, and displays information corresponding to a signal from the CPU circuit block 150 on the display.

The folding unit controller 401 is mounted on the folding unit 400 and controls the operation of the entire folding unit 400 by receiving and transmitting information to and from the CPU circuit block 150.

The finisher controller 501 is mounted on the finisher 500 and controls the operation of the entire finisher 500 by receiving and transmitting information to and from the CPU circuit block 150. The contents of this control will be described later.

Figure 4:
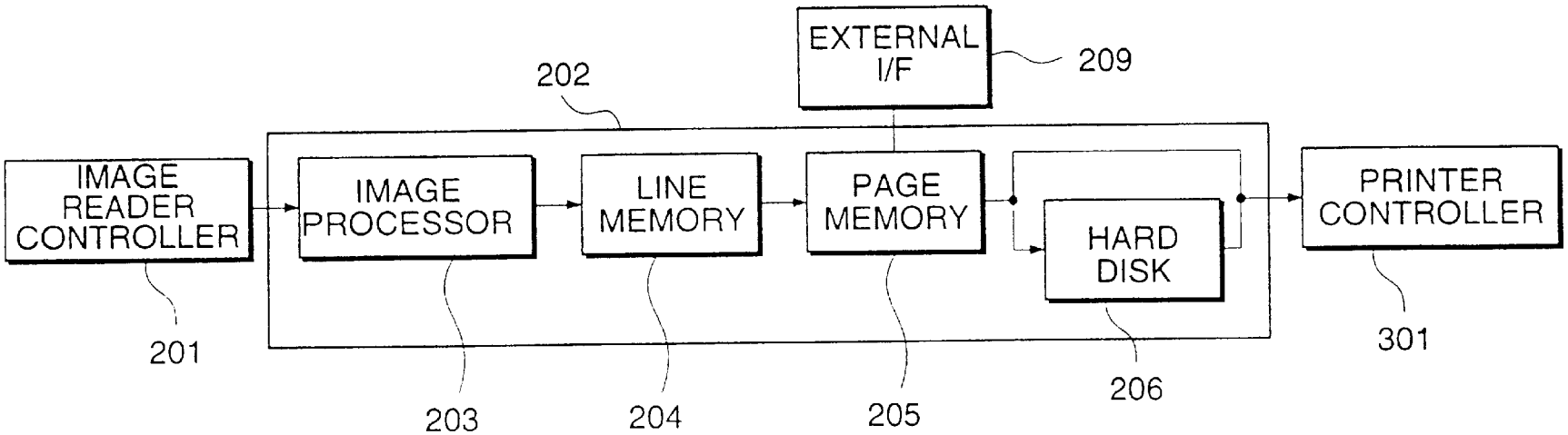
FIG. 4 is a block diagram showing the construction of an image signal controller 202 appearing in FIG. 3.

Next, the construction of the image signal controller 202 will be described with reference to FIG. 4. FIG. 4 is a block diagram showing the construction of the image signal controller 202.

As shown in FIG. 4, the image signal controller 202 includes an image processor 203 that converts the analog image signal from the image reader controller 201 into a digital signal, and performs various processing operations on this digital signal. In the image processor 203, various processing operations are performed such as shading correction, density correction, editing operations set by the operation part 153 (magnification setting operation such as enlargement/reduction), and others. Signals resulting from these processing operations are stored as video data in a line memory 204. When a book-binding mode is selected, image allocation to the sheets is performed based on the number of pages of the original read out and the number of pages of image data input via an external I/F 209.

The line memory 204 is used for performing the above-mentioned mirror image processing. Video data for one line which has been read out in one main scanning direction is rearranged in direction to the opposite direction on this memory, as required. The video data output from the line memory 204 are stored in a page memory 205.

The page memory 205 has a capacity for storing one page of an original of a predetermined size. The video data are stored in the page memory 205 in the order in which they are output from the line memory 204. In the stationary original reading, the stored video data are read out in the order in which they are stored. The page memory 205 also stores data output from the computer 210 via the external I/F 209.

The video data read out from the page memory 205 are delivered to the printer controller 301 directly, or if required, after being temporarily stored in a hard disk 206. This hard disk 206 is used for an operation of changing the page order.

Figure 5:
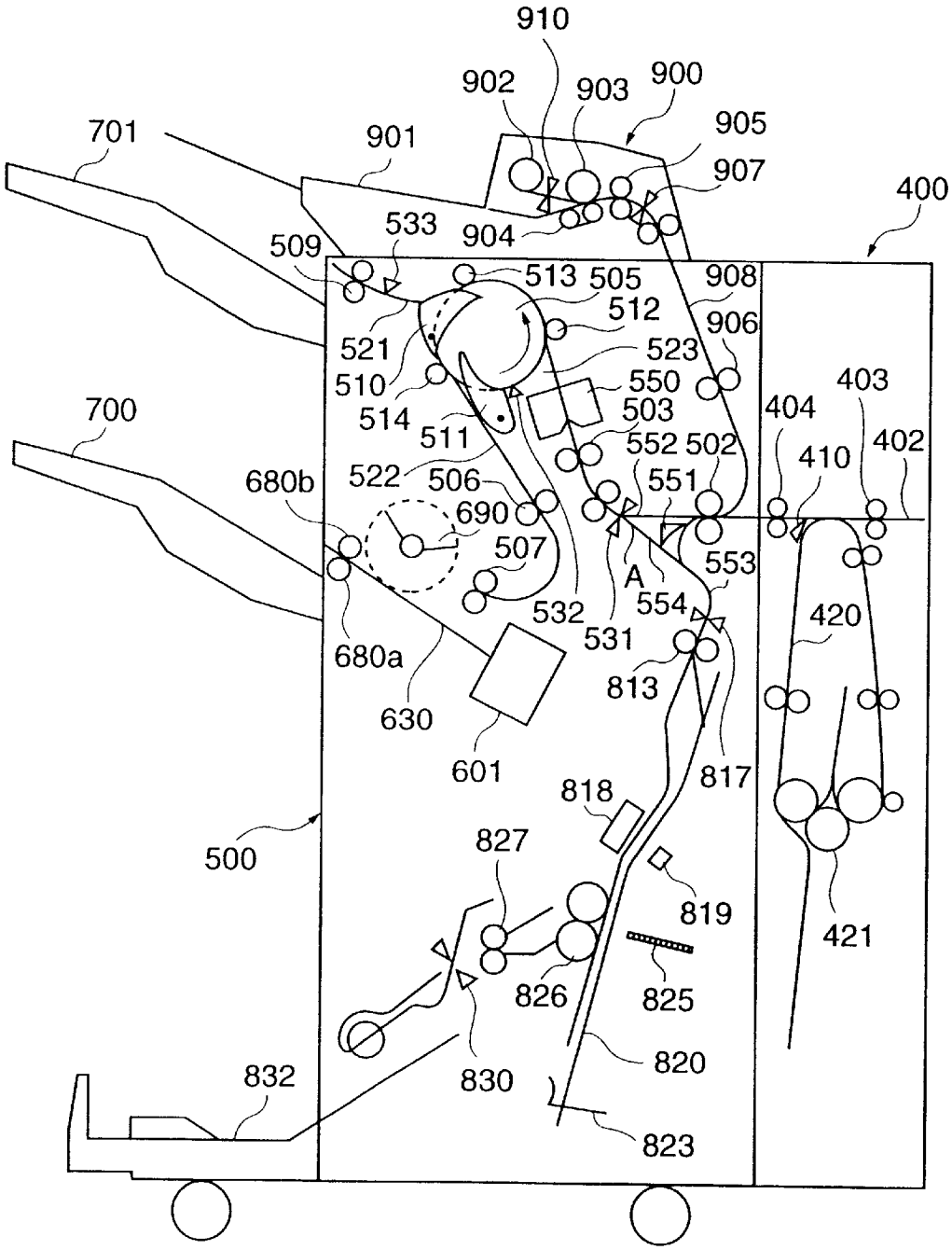
FIG. 5 is a schematic view showing the construction of a folding unit 400 and a finisher 500 appearing in FIG. 1.

Next, the construction of the folding unit 400 and the finisher 500 will be described with reference to FIG. 5. FIG. 5 is a schematic view showing the construction of the folding unit 400 and the finisher 500.

As shown in FIG. 5, the folding unit 400 includes a folding conveyance horizontal path 402 that introduces sheets discharged from the printer 300 and guides them toward the finisher 500. Conveyance roller pairs 403 and 404 are provided on the folding conveyance horizontal path 402. At an exit of the folding conveyance horizontal path 402 (on the finisher 500 side), there is provided a folding path selecting flapper 410. The folding path selecting flapper 410 performs a switching action for selectively guiding sheets on the folding conveyance horizontal path 402 to a folding path 420 or toward the finisher 500.

When a folding operation is performed, the folding path selecting flapper 410 is switched on to guide sheets to the folding path 420. The sheets guided to the folding path 420 are conveyed to a folding roller 421 to be folded in the form of Z thereby. On the other hand, when the folding operation is not performed, the folding path selecting flapper 410 is switched off, and the sheets sent from the printer 300 via the folding conveyance horizontal path 402 are guided directly to the finisher 500.

The finisher 500 successively takes in the sheets discharged via the folding unit 400, and performs sheet post-processing operations such as a bundling operation of aligning a plurality of sheets taken in into a single bundle, a stapling operation of stapling a rear end of the aligned bundle, a punching operation of punching the sheets taken in near rear ends thereof, a sort operation, a non-sort operation, and a book-binding operation.

As shown in FIG. 5, the finisher 500 includes an entrance roller pair 502 that introduces the sheets discharged from the printer 300 via the folding unit 400 into the finisher 500. Downstream of this entrance roller pair 502, there is provided a switching flapper 551 which selectively guides the sheets to a finisher path 552 or to a first book-binding path 553.

The sheets guided to the finisher path 552 are sent toward a buffer roller 505 via a conveyance roller pair 503. The conveyance roller pair 503 and the buffer roller 505 are both reversible in rotating direction for forward rotation and reverse rotation.

An entrance sensor 531 is provided between the entrance roller pair 502 and the conveyance roller pair 503. A second book-binding path 554 branches off from the finisher path 552 near the entrance sensor 531 at an upstream side thereof in the sheet conveying direction. This branch point will be hereinafter referred to as the branch A. The branch A constitutes a branching point from a conveyance path which conveys sheets from the entrance roller pair 502 to the conveyance roller pair 503. When the conveyance roller pair 503 is reversed in rotation to convey sheets from the conveyance roller pair 503 to the entrance sensor 531, the branch A constitutes a branching point forming a one-way mechanism which conveys sheets only to the second book-binding path 554.

A punching unit 550 is provided between the conveyance roller pair 503 and the buffer roller pair 505. The punching unit 550 is operated as required so as to punch the conveyed sheets near the rear ends thereof.

The buffer roller 505, unit for executing a sheet staying process to a sheet from the upstream side (the main body 300 or inserter 900), is adapted to have a predetermined number of the conveyed sheets wound thereon in lamination, and if required, small depressing rollers 512, 513, 514 may be arranged at the periphery of the roller 505 to assist the sheets to be wound on the roller 505. The sheets wound on the buffer roller 505 are conveyed in the rotating direction of the buffer roller 505.

A switching flapper 510 is provided between the depressing rollers 513 and 514, and a switching flapper 511 is provided on the downstream side of the depressing roller 514. The switching flapper 510 serves to separate the sheets wound on the buffer roller 505 from the latter and selectively guide them to a non-sort path 521 or to a sort path 522. The switching flapper 511 serves to either separate the sheets wound on the buffer roller 505 to guide them to the sort path 522, or guide the sheets as they are wound on the buffer roller 505 to a buffer path 523.

By winding a sheet or sheets to be conveyed from the upstream side (the image forming apparatus main body or the inserter 900) toward a tray 630 (or a tray 701) on the buffer roller 505 to thereby stay conveyance of the sheet temporarily, a difference in the processing speed between the image forming apparatus side and the finisher side can be absorbed without lowering productivity of the image forming apparatus side.

For example, let it be assumed that the processing speed of the image forming apparatus is higher than that of the finisher side, and that while sheets of one group are stacked on the processing tray 630 and are being stapled by a stapler 601, sheets of another group (or another job) different from the above group are conveyed from the main body of the image forming apparatus into the finisher 500 and these sheets are also to be conveyed to the same tray 630 as the preceding group.

In such a situation, conveyance of the sheets of this succeeding group toward the processing tray 630 will give rise to a problem since stapling of the preceding group is being executed on the processing tray 630.

In order to overcome the above problem, the operation of the image forming apparatus may be temporarily suspended, and be resumed again after the processing operation on the finisher side has been completed. However, this may lower the productivity of the image forming apparatus.

Therefore, the sheet processing apparatus according to the present embodiment is constructed such that when, as in the above example, the destination of the succeeding group of sheets is the same as that of the preceding group of sheets, and the sheets of the preceding group are being processed (or are about to be processed) at a location (for example, on the processing tray 630) in the finisher 500, the sheets of the succeeding group are wound around the buffer roller 505 which are capable of having one or more (in the following example, three) sheets wound thereon, to thereby temporarily keep the sheets on standby, i.e. temporarily stay the conveyance of the sheets. Upon completion of the processing of the preceding group of sheets, the wound sheets are separated from the buffer roller 505 to be conveyed again. This will be described more specifically with reference to the following example.

As an example, a case will be considered in which while a processing operation (a sheet aligning operation, a stapling process, a bundle discharging operation or the like) of the preceding group of sheets is being executed on the processing tray 630, the succeeding group of three pages of sheets is conveyed into the finisher 500 successively beginning with the top page.

In this case, a winding action by the buffer roller 505 of a first-page sheet of the succeeding group of three pages of sheets is started by causing the buffer roller 505 to be rotated (the rotating direction is shown by an arrow in FIG. 5), and the rotation of the roller 505 is continued until the leading edge of the sheet reaches a predetermined position on the buffer path 523 (near the position of the sensor 532). When the leading edge of the sheet reaches the predetermined position, the rotation of the buffer roller 505 is stopped (at this time point, processing of the preceding group of sheets has not been completed).

Then, in timing such that a second-page sheet can be wound in superposition upon the first-page sheet with its leading edge slightly displaced with respect to that of the first-page sheet, the rotation of the buffer roller 505 with the first-page sheet wound thereon is resumed (the rotating direction is shown by the arrow in FIG. 5). A winding action by the buffer roller 505 is performed such that the second-page sheet is superposed on the first-page sheet with the leading edge of the second-page sheet slightly displaced with respect to the leading edge of the first-page sheet (that is, when the leading edge of the first-page sheet passes the roller 512 upwardly from below, the second-page sheet starts to be wound on the buffer roller 505 in superposition upon the first-page sheet). As before, the rotation of the buffer roller 505 is continued until the leading edge of the sheet reaches the above-mentioned predetermined position on the buffer path 523, whereupon the rotation of the buffer roller is stopped.

Then, in timing such that a third-page sheet can be wound in superposition upon the second-page sheet with its leading edge slightly displaced with respect to that of the second-page sheet, the rotation of the buffer roller 505 with the first-page and second-page sheets wound thereon is resumed (the rotating direction is shown by the arrow in FIG. 5). Then, the third-page sheet is wound on the buffer roller 505 in superposition upon the second-page sheet with the leading edge of the third-page sheet slightly displaced with respect to that of the second-page sheet.

Thus, winding of a plurality of sheets on the buffer roller 505 is carried out such that the sheets wound on the buffer roller 505 are each displaced with respect to the preceding sheet in the sheet conveyance direction, and the displacement of the plurality of sheets wound on the buffer roller 505 is such that the top or first-page sheet is situated on the most downstream side in the sheet conveyance direction and each succeeding page is displaced with respect to the preceding one toward the upstream side in the sheet conveyance direction. By thus controlling the winding of a plurality of sheets on the buffer roller 505 such that each sheet is successively slightly displaced toward the upstream side with respect to the preceding one, when the plurality of sheets wound on the buffer roller 505 are separated from the buffer roller 505, it is possible to convey these sheets downstream in the sheet conveyance direction without changing the page order of the sheets.

Upon confirmation that the final processing operation on the preceding group of sheets on the processing tray 630 (for example, a sheet bundle discharging from the tray 630 to a tray 700) has been completed, the flapper 511 is switched to the path 522, and the three sheets wound on the buffer roller 505 in slightly displaced relationship with each other as described above are separated from the buffer roller 505 near the roller 514 (thus, in this case, the three sheets are separated from the buffer roller 505 during its one complete rotation beginning with the winding of the third sheet). These sheets are guided without changing the page order to the path 522, and further guided via the roller 507 to be stacked on the tray 630.

The sheets are discharged from the roller 507 and stacked on the tray 630 with the image-formed surfaces facing downward (thus, the lowest sheet of the sheet bundle on the processing tray 630 is the top first-page sheet and the topmost sheet of the sheet bundle on the tray is the last page sheet).

A CPU mounted on the finisher 500 obtains information concerning the sheet processing status in the finisher 500 in terms of each page (each recording sheet) based on the detection results from a plurality of sensors including various sensors shown in FIG. 5, and transmits the information via a signal line to the main body of the image forming apparatus. On the other hand, the CPU on the main body of the image forming apparatus that has received the information adjusts, for example, the timing of the onset of image forming operation so as to control the interval of conveyance of sheets.

The CPU mounted on the finisher 500 and the CPU mounted on the main body of the image forming apparatus thus communicate with each other and transmit and receive various data such as information concerning the operational status of the respective apparatuses, command data, data concerning the attributes (type) of the sheets to be conveyed (described later) and control data, to thereby control whether the sheet winding and staying operation on the buffer roller 505 should be executed or not (described later), and control the timing of the onset and suspension of the rotation of the buffer roller 505 as well as the timing of the sheet conveyance action.

The sheets guided to the non-sort path 521 by the switching flapper 510 are discharged onto the sample tray 701 via a discharging roller pair 509. A sheet discharging sensor 533 is provided in the non-sort path 521 for detecting a jam or the like.

The sheets guided to the sort path 522 by the switching flapper 510 are stacked onto the intermediate tray (hereinafter referred to as "processing tray") 630 via conveyance rollers 506, 507. The sheets stacked in a bundle on the processing tray 630 are discharged onto the stack tray 700 by discharging rollers 680*a*, 680*b*, after being subjected to an aligning operation, a stapling operation and so forth as required. The stapler 601 is used for the stapling operation to bind together the sheets stacked in a bundle on the processing tray 630. The operation of this stapler 601 will be described later. The stack tray 700 is freely movable in a vertical direction.

The sheets from the first book-binding path 553 and the second book-binding path 554 are stored in a receiving guide 820 by a conveyance roller pair 813, and are further conveyed until the leading edges of the sheets abut on a movable sheet positioning member 823. A book-binding entrance sensor 817 is provided on the upstream side of the conveyance roller pair 813. Two pairs of staplers 818 are provided in an intermediate position of the receiving guide 820. The staplers 818 cooperate with an anvil 819 arranged opposite thereto to bind a bundle of sheets at a center thereof.

A folding roller pair 826 is provided downstream of the staplers 818. A thrusting member 825 is provided opposite to the folding roller pair 826. By thrusting out the thrusting member 825 against the bundle of sheets in the receiving guide 820, the bundle of sheets is pushed between the rollers of the folding roller pair 826 to be folded by the folding roller pair 826. Then, the folded bundle of sheets is discharged onto a saddle discharging tray 832 via a folded-sheet discharging roller 827. A book-binding discharging sensor 830 is provided downstream of the folded-sheet discharging roller 827.

When a bundle of sheets that has been bound with the staplers 818 is to be folded, after the stapling operation is completed, the positioning member 823 is lowered by a predetermined distance to bring the stapling position to the center of the folding roller pair 826.

The inserter 900 is provided on the top of the finisher 500, and guides special sheets having images formed thereon beforehand directly into the finisher 500 without passing through the main body of the image forming apparatus. These special sheets are used as cover sheets or interleaved sheets for a bundle of sheets which have images formed thereon by the image forming apparatus. The inserter 900 successively separates a bundle of sheets forming cover sheets or interleaved sheets stacked on a tray 901, and feeds them to the finisher path 552 or to the book-binding path 553. Special sheets are stacked on the tray 901 of the inserter 900 in a normal vision position as viewed from an operator, that is, stacked on the tray 901 with their front or image-formed surfaces directed upward.

The special sheets on the tray 901 are conveyed by a conveyance roller-feeding roller 902 to a separation section consisting of a conveyance roller 903 and a separation belt 904, where they are successively separated and conveyed one by one starting with the top sheet.

A draw roller pair 905 is provided downstream of the separation section. Special sheets which have been separated are stably guided by this draw roller pair 905 to a conveyance path 908. A sheet feed sensor 907 is provided downstream of the draw roller pair 905. A conveyance roller 906 is provided between the sheet feed sensor 907 and the entrance roller pair 502 to lead the special sheets on the conveyance path 908 to the entrance roller pair 502.

Next, control processes performed by the finisher 500 will be described with reference to FIGS. 6 through 18. The control processes of the finisher 500 are executed by the finisher controller 501 in accordance with commands from the CPU circuit block 150.

Figure 6:
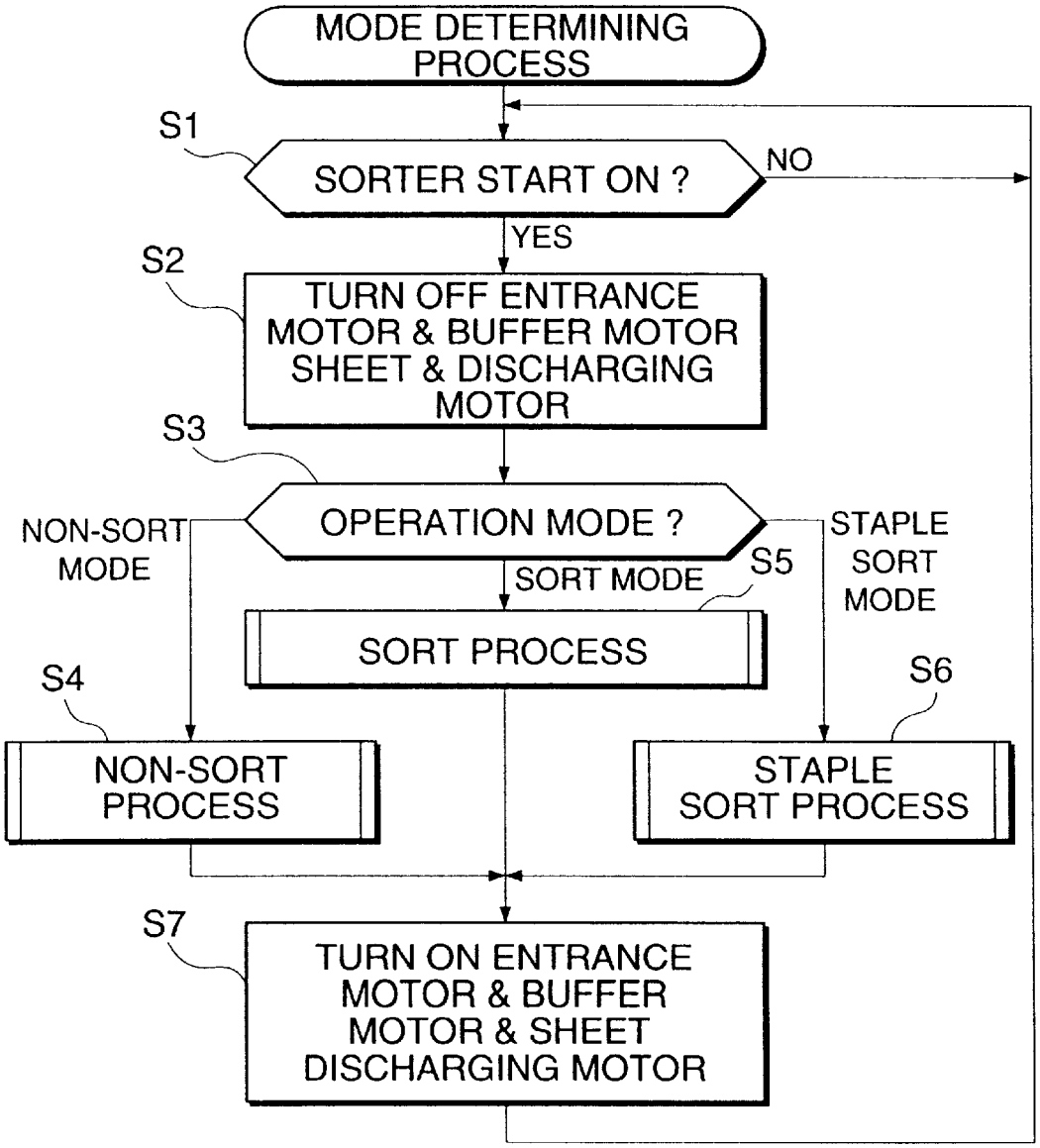
FIG. 6 is a flow chart showing a mode determining process performed by the finisher of the image forming apparatus of FIG. 1.

First, a mode determining process will be described with reference to FIG. 6. FIG. 6 is a flow chart showing the mode determining process performed by the finisher 500.

In the mode determining process, as shown in FIG. 6, in step S1, the finisher 500 waits for a finisher start signal (sorter start signal) which instructs initiation of the operation of the finisher 500 to be generated. This start signal is generated by the CPU circuit block 150 and delivered to the finisher controller 501 upon depression of a start key on the operation part 153 that instructs initiation of copying. The finisher 500 is kept on standby until this start signal is generated.

When the start signal is generated and delivered to the finisher controller 501, the process proceeds to step S2, where driving of an entrance motor, a buffer motor, a sheet discharging motor and the like is started. In the following step S3, it is determined which of a non-sort mode, a sort mode, or a staple sort mode is the set operation mode.

If the set operation mode is the non-sort mode, the process proceeds to step S4, where a non-sort process is executed. If the set operation mode is the sort mode, the process proceeds to step S5, where a sort process is executed. If the set operation mode is the staple sort mode, the process proceeds to step S6, where a staple sort process is executed. When the corresponding operation has been executed, the process proceeds to step S7, where the entrance motor, the buffer motor and the sheet discharging motor are turned off, and the process returns to the above-mentioned step S1 to again wait for the finisher start signal to be generated.

When a sheet feed from the inserter 900 is designated, special sheets fed from the inserter 900 are subjected together with ordinary sheets to the processing operation in each of the steps S4, S5 and S6.

Figure 7:
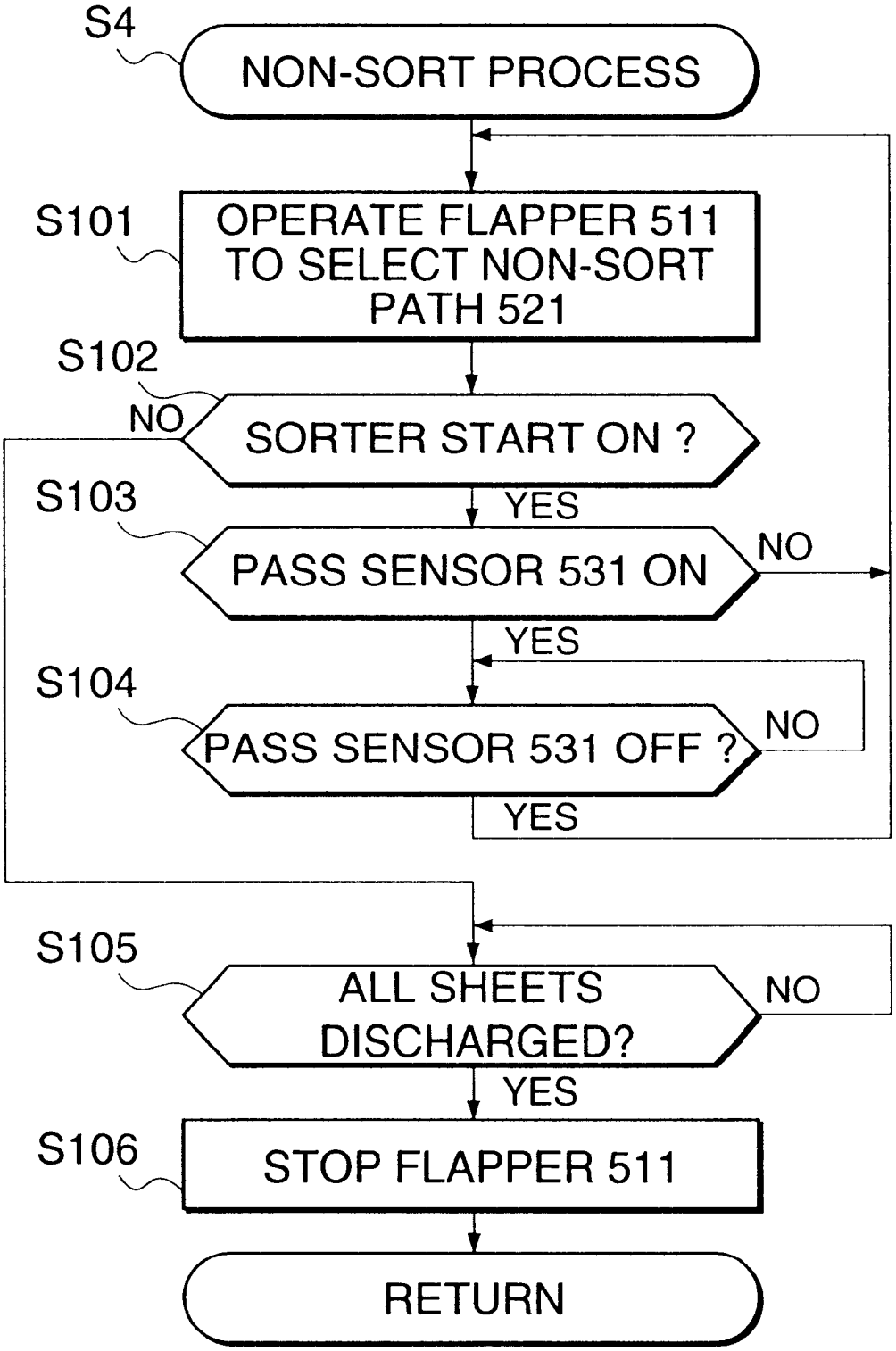
FIG. 7 is a flow chart showing a non-sort process executed in a step S4 of FIG. 6.

Next, the non-sort process in the step S4 will be described with reference to FIG. 7. FIG. 7 is a flow chart showing the non-sort process executed in step S4 of FIG. 6.

In the non-sort process, as shown in FIG. 7, first, in step S101, the switching flapper 511 is operated to select the non-sort path 521. On this occasion, the finisher path 552 has been selected by the switching flapper 551. In the following step S102, it is determined whether the finisher start signal (sorter start signal) has been generated or not. If the finisher start signal has been generated, which means that a sheet discharged from the printer 300 has been conveyed into the finisher 500, it is determined in step S103 whether the pass sensor 531 has generated an output signal or not. If the pass sensor 531 has not generated the output signal, the process returns again to the above-mentioned step S102. On the other hand, if the pass sensor 531 has generated the output signal, judging that the leading edge of the sheet conveyed into the finisher 500 has reached the pass sensor 531, the process proceeds to step S104 to wait the output signal from the pass sensor 531 to be stopped. When the pass sensor 531 has ceased to generate the output signal, judging that the sheet has passed the pass sensor 531, the process returns again to the above-mentioned step S102, and resumes the monitoring of the conveyance of sheets using the pass sensor 531.

If it is determined in the above-mentioned step S102 that the finisher start signal has been stopped, judging that the image formation has been completed in the printer 300, the process proceeds to step S105 to wait for all the sheets to be discharged onto the sample tray 701. When all the sheets have been discharged, the process proceeds to step S106, where the flapper 511 is stopped, followed by terminating the present process.

Figure 8:
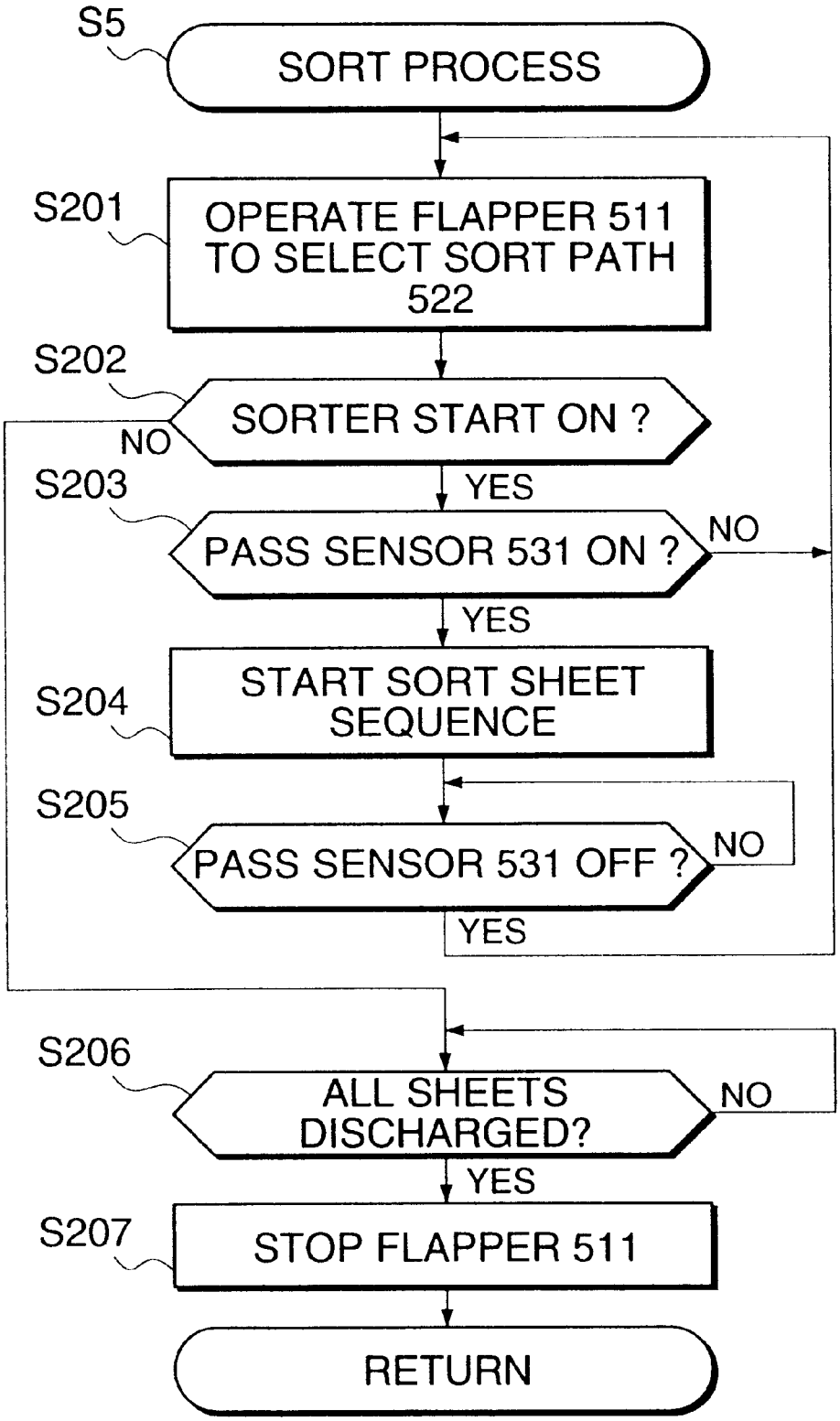
FIG. 8 is a flow chart showing a sort process executed in a step S5 of FIG. 6.

Next, the sort process in the step S5 of FIG. 6 will be described with reference to FIG. 8. FIG. 8 is a flow chart showing the sort process executed in the step S5 of FIG. 6.

In the sort process, as shown in FIG. 8, first, in step S201, the flapper 511 is operated to select the sort path 522. On this occasion, the finisher path 552 has been selected by the switching flapper 551. In the following step S202, it is determined whether the finisher start signal has been generated or not. If the finisher start signal has been generated, which means that a sheet discharged from the printer 300 has been conveyed into the finisher 500, it is determined in step S203 whether the pass sensor 531 has generated the output signal or not, and if the pass sensor 531 has not generated the output signal, the process returns again to the above-mentioned step S202.

On the other hand, if the pass sensor 531 has generated the output signal, judging that the leading edge of the sheet conveyed into the finisher 500 has reached the pass sensor 531, the process proceeds to step S204, where a sort sheet sequence is started.

In the following step S205, the process waits for the pass sensor 531 to stop generating the output signal. When the pass sensor 531 has stopped generating the output signal, judging that the sheet has passed the pass sensor 531, the process returns to the above-mentioned step S202, and resumes the monitoring of the conveyance of sheets using the pass sensor 531.

If it is determined in the above-mentioned step S202 that the finisher start signal has ceased to be generated, judging that the image formation in the printer 300 has been completed, the process proceeds to step S206 to wait for all the sheets to be discharged onto the stack tray 700. When all the sheets have been discharged, the process proceeds to step S207, where the flapper 511 is stopped, followed by terminating the present process.

Figure 9:
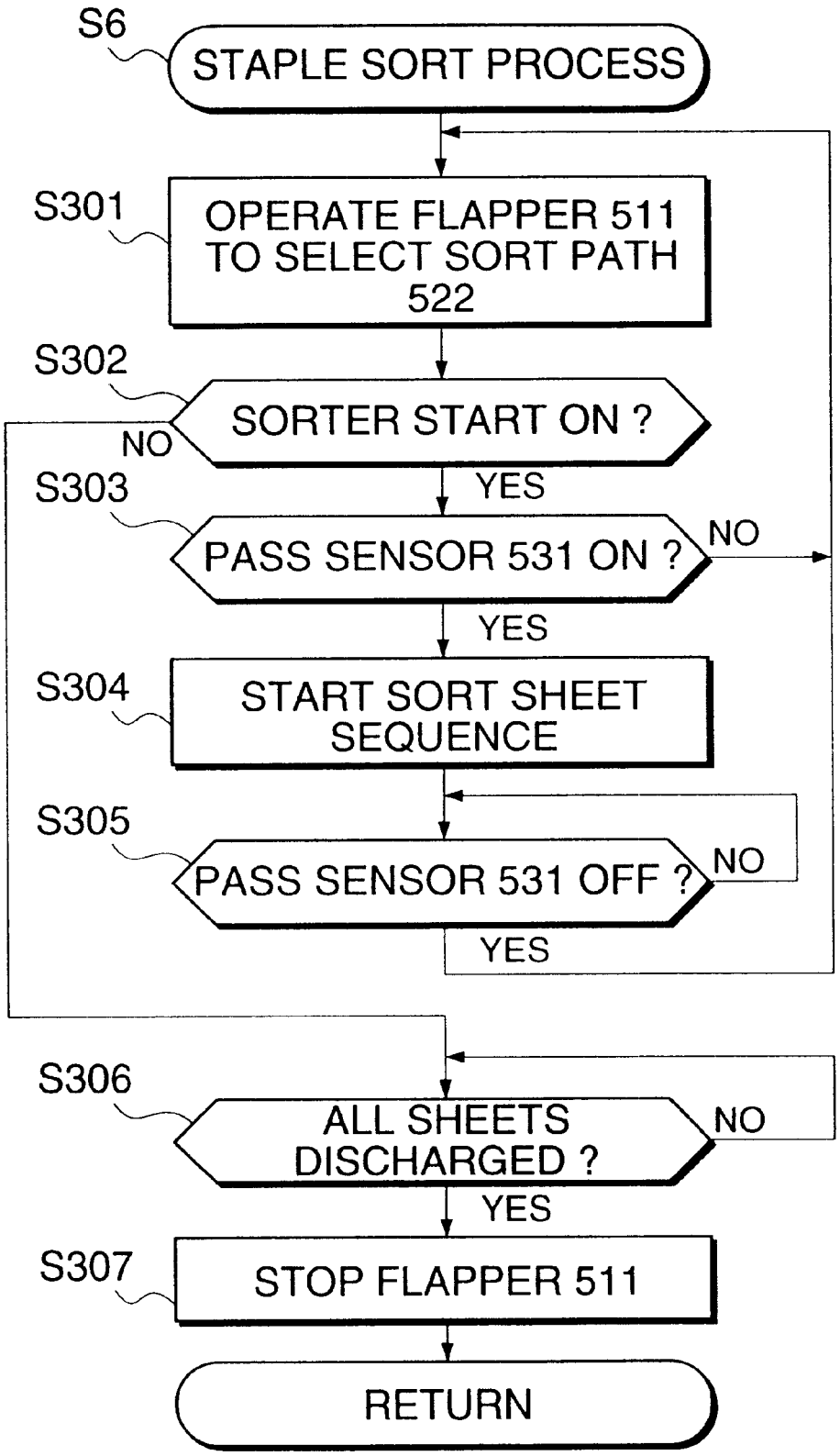
FIG. 9 is a flow chart showing a stapling sort process executed in a step S6 of FIG. 6.

Next, the staple sort process in the step S6 of FIG. 6 will be described with reference to FIG. 9. FIG. 9 is a flow chart showing the staple sort process in the step S6 of FIG. 6.

In the staple sort process, as shown in FIG. 9, first, in step S301 the flapper 511 is operated to select the sort path 522. On this occasion, the finisher path 552 has been selected by the switching flapper 551. In the following step S302, it is determined whether the finisher start signal has been generated or not. If the finisher start signal has been generated, which means that a sheet discharged from the printer 300 has been conveyed into the finisher 500, it is determined in step S303 whether the pass sensor 531 has generated the output signal or not. If the pass sensor 531 has not generated the output signal, the process returns again to the above-mentioned step S302.

On the other hand, if the pass sensor 531 has generated the output signal, judging that the leading edge of the sheet conveyed into the finisher 500 has reached the pass sensor 531, the process proceeds to step S304, where the sort sheet sequence is started.

Then, in the following step S305, the process waits for the pass sensor 531 to stop generating the output signal. When the pass sensor 531 has ceased to generate the output signal, judging that the sheet has passed through the pass sensor 531, the process returns to the above-mentioned step S302, and resumes the monitoring of the conveyance of sheets using the pass sensor 531.

If in the above-mentioned step S302 it is determined that the finisher start signal has ceased to be generated, judging that the image formation in the printer 300 has been completed, the process proceeds to step S306, where the process waits for all the sheets to be discharged onto the stack tray 700. When all the sheets have been discharged, the process proceeds to step S307, where the flapper 511 is stopped, followed by terminating the present process.

Figure 11:
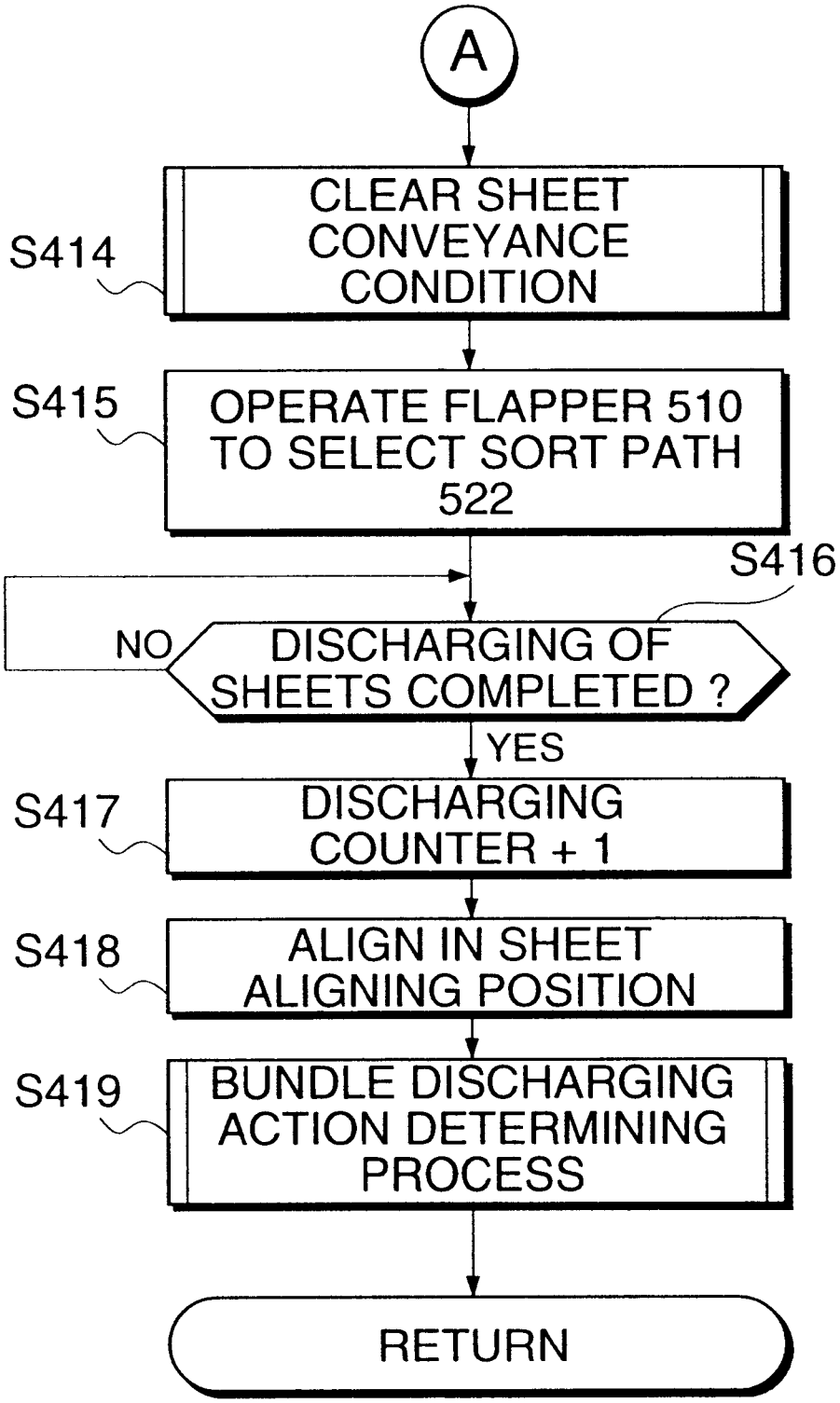
FIG. 11 is a flow chart showing a sort sheet sequence executed in steps S204 and S304 of FIGS. 8 and 9.
Figure 17:
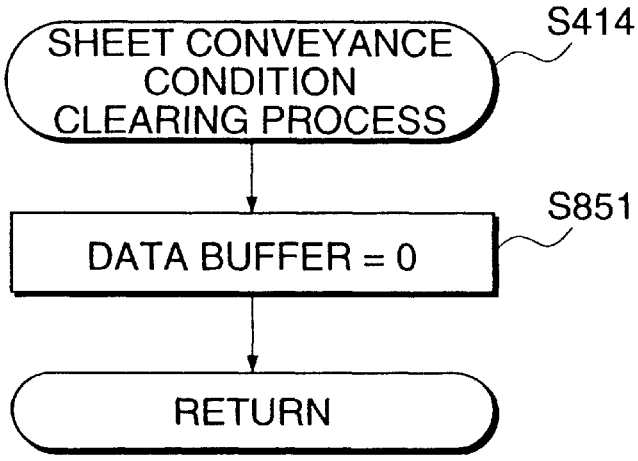
FIG. 17 is a flow chart showing a sheet conveyance condition clearing process executed in a step S414 of FIG. 11.

Next, the sort sheet sequence in the steps S204, S304 of FIGS. 8 and 9 will be described with reference to FIGS. 10, 11 and 17. FIGS. 10 and 11 are flow charts showing the process of sort sheet sequence executed in the steps S204 and S304 of FIGS. 8 and 9. FIG. 17 is a flow chart showing a sheet conveyance condition clearing process executed in step S414 of FIG. 11.

This operation is started from the sort process or the staple sort process, and is assigned to each of the sheets conveyed. The program is executed as a multi-task.

First, in step S401, a sheet attribute determining process is performed. This operation, which will be described in detail later, determines the attributes of the sheet conveyed, that is, whether it is a sheet to be wound on the buffer roller 505, or whether it is a sheet to be stacked onto the processing tray 630 and discharged as a bundle.

In the following step S402, conveyance for 50 [mm] is performed, where the driving of the buffer motor is started. Since the sort sheet sequence is started when the pass sensor 531 starts generating the output signal, the driving of the buffer motor is started when the sheet has been conveyed 50 [mm] downstream from the position where the leading edge of the sheet reached the pass sensor 531. This is for the subsequent conveyance of the sheet, and also for adjusting the timing for restart of wound sheets which have been wound and stayed on the buffer roller 505 (described later), so that the sheet can be conveyed together with the wound sheets in superposition. Although the value of 50 [mm] is set as the condition to define the timing in the present embodiment, any arbitrary value may be set as this condition. Conveyance for 150 [mm] is performed in step S404.

Next, the process proceeds to step S405, where it is determined whether the sheet is designated as a sheet to be wound or not. If the sheet is designated as a sheet to be wound, the process proceeds to step S406. Otherwise, the process proceeds to step S414.

In step S406, the flapper 510 is operated to select the buffer path 523. The sheet can be thus guided to the conveyance path 523 with conveyance of the sheet so that the sheet is wound on the buffer roller 505. In step S407, the process waits for the pass sensor 532 on the buffer path 523 to generate the output signal. When the pass sensor 532 has generated the output signal, the process proceeds to step S408, where the buffer roller 505 is stopped. This control causes the sheet to be stopped at a position where the leading edge is beyond the pass sensor 532. This, however, causes no problem if the amount of the overrun is taken into account in performing the above-mentioned winding operation.

After the buffer roller 505 is stopped, the subsequent processing may be performed in two ways. The first way of processing is to keep the buffer roller 505 on standby with the sheets wound thereon until a succeeding sheet causes restarting of the buffer roller 505, and discharge these wound sheets together with the succeeding sheet upon restart of the buffer roller. The second way of processing is to automatically restart the buffer roller 505 and discharge the sheets in response to some event. In the present embodiment, a wound sheet discharging flag, referred to later, indicates such an event that causes the automatic discharging of the sheets.

More specifically, in step S409, it is determined whether a wound sheet discharging flag is 1 or not. If a wound sheet discharging flag is not 1, the process proceeds to step S410, where it is determined whether the discharging of the sheets on the processing tray 630 has been completed or not. If this discharging has not been completed, the process returns to step 409, where the wound discharging flag is monitored until the discharging of the sheets on the processing tray 630 is completed. When the discharging of the sheets on the processing tray 630 has been completed, the process proceeds to step S411, where a discharging counter is counted up by one, followed by termination of the present process. This sequence of operations constitutes the first way of processing. The second way of processing will be described later.

If in the above-mentioned step S405 it is determined that the sheet is not a sheet to be wound, the process proceeds to step S414 of FIG. 11, where the sheet conveyance condition is cleared. In this operation, as shown in FIG. 17, in step S851, buffer data indicating the sheet conveyance condition are cleared. The data are used in the sheet attribute determining process. In the following step S415, the flapper 510 is operated to select the sort path 522. By thus operating the flapper 510, the sheet is guided not to the above-mentioned buffer path 523, but to the path 522 that is the discharging path to the processing tray 630, and the sheet is conveyed to the processing tray 630.

Next, the process proceeds to step S416 to wait for the discharging of the sheets onto the processing tray 630 to be completed. Then, in the following step S417, the discharging counter is counted up by one. In step S418, an aligning action is performed, and in step S419, a bundle discharging action determining process which will be described later is performed, followed by terminating the present process.

In the above action of discharging sheets onto the processing tray 630, in addition to the discharging of the sheets, an aligning action is performed to align the sheets in a direction generally perpendicular to the sheet conveyance direction is performed, and an aligning acting is also performed to align the sheets in the sheet conveyance direction, by rotating a paddle. Detailed description of these aligning actions are omitted.

Next, the above-mentioned second way of processing after the buffer roller 505 is stopped with the sheets wound thereon will be described. In this case, since the wound sheet discharging flag is set to indicate that the discharging of the sheets from the buffer roller 505 is to be performed not concurrently with the conveyance of the succeeding sheet, the process proceeds from step S409 to step S412. In step S412, the wound sheet discharging flag is reset, and in the following step S413, the driving of the buffer roller 505 is started to discharge the sheets. A sequence of operations at steps S414 to S419 is performed as in the above-described case of the sheet being not to be wound. That is, the sheet conveyance condition is cleared, the flapper is switched, and discharging of the sheets onto the processing tray 630 is performed.

By thus carrying out the control so as to enable automatic discharging of sheets from the buffer roller, an undesirable mismatch on the processing tray 630 that is expected to arise due to a mismatch of the conveyance speed or the like between a plurality of sheets which are discharged simultaneously can be avoided.

Figure 13:
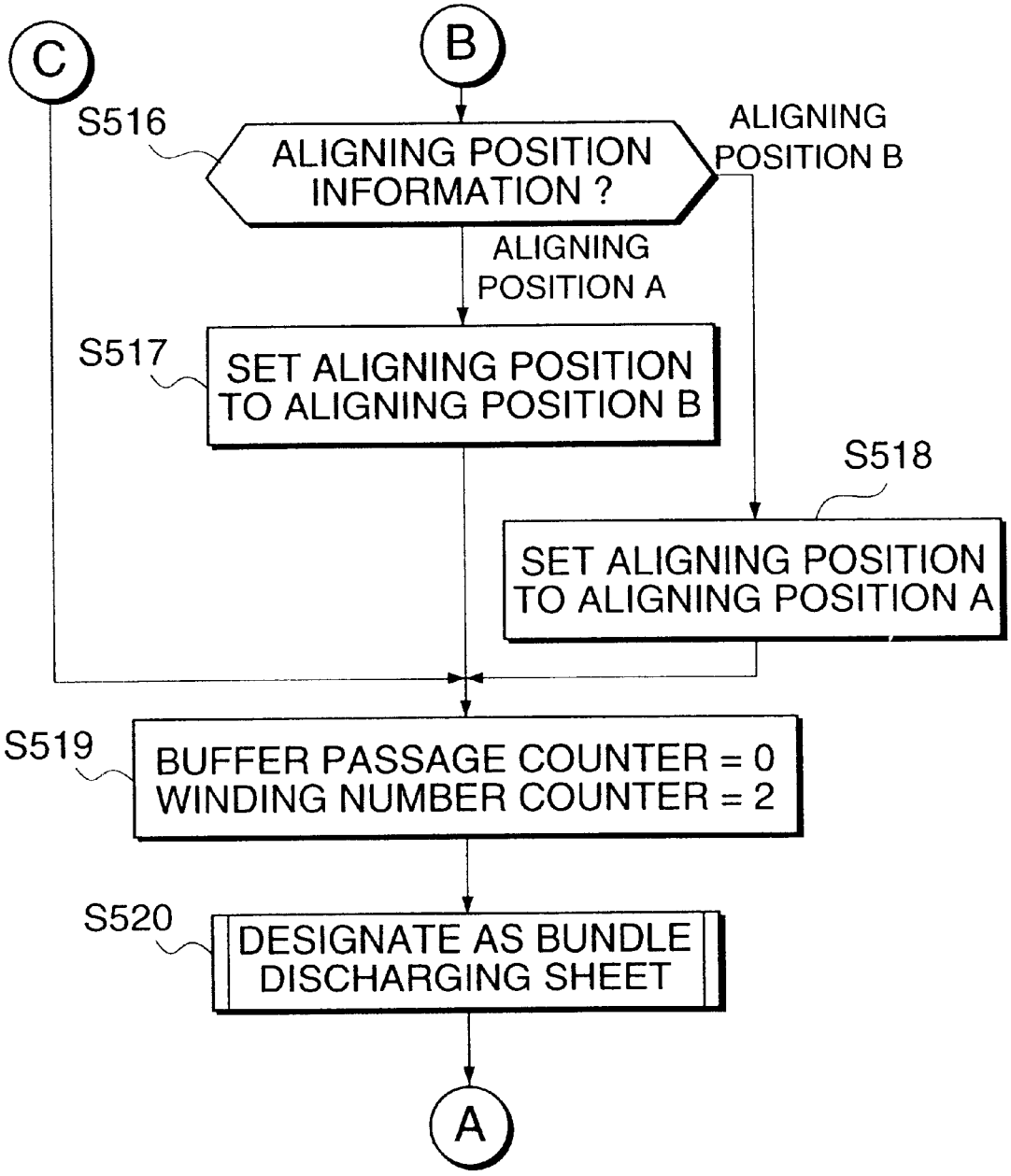
FIG. 13 is a flow chart showing a sheet attribute determining process executed in a step S401 of FIG. 10.

Next, the sheet attribute determining process will be described with reference to FIGS. 12 and 13. FIGS. 12 and 13 are flow charts showing the sheet attribute determining operation in the step S401 of FIG. 10.

First, in step S501, a buffer passage counter is counted up by one, and in step S502, aligning position information is stored in the sheet aligning position. In step S503, it is determined whether the sheet is the last sheet of a bundle or not. Here, a bundle means a unit of grouping in the sort mode, or a unit of stapling in the staple sort mode. If the sheet is determined to be the last sheet of a bundle, the process proceeds to step S516 shown in FIG. 13 which will be described later.

On the other hand, if the sheet is not the last sheet of a bundle, the process proceeds to step S504, where a sheet material determining process is performed. In the following step S505, it is determined whether a sp_material_flag (special material flag) is on or not. If this flag is on, the process proceeds to step S514, and if this flag is off, the process proceeds to step S506.

In step S506, it is determined whether the sheet is of a size that permits it to be wound on the buffer roller or not. If the sheet is of a size that permits it to be wound on the buffer roller, the process proceeds to step S507, and otherwise, the process proceeds to step S514. In step S507, referring to a winding number counter which indicates the maximum allowable number of sheets that can be wound, it is determined whether the count value of this counter is 0 or not. If the count value of the winding number counter is not 0, the process proceeds to step S512, where the count value of the counter is decreased by one, and in the following step S513, a sheet conveyance condition determining process is performed. This operation discriminates whether the sheet should be designated as a sheet to be wound or not (described later), followed by terminating the present process.

The purpose of the winding of sheets on the buffer roller is to stay the conveyed sheets temporarily on the roller so that they can be discharged together with the succeeding sheet to give ample time for processing operation in the downstream side, and to improve the productivity. If the count value of the winding number counter is 0, the process proceeds to step S508, where it is determined whether the operation mode is the sort mode or not. If the operation mode is not the sort mode (that is, the operation mode is the staple sort mode), the present process is terminated. If the operation mode is the sort mode, the process proceeds to step S509, where it is determined whether the count value of the buffer passage counter is 4 or not. When the count value of the buffer passage counter is 4, in step S510, it is determined whether the sheet is the second last sheet of the bundle or not. If the sheet is the second last sheet of the bundle, the process proceeds to step S519 shown in FIG. 13. If the sheet is not the second last sheet of the bundle, the present process is terminated. In step S519, the buffer passage counter is cleared to 0, and in the following step S520, a bundle discharging is designated, followed by terminating the present process.

If in the step S509 it is determined that the count value of the buffer passage counter is not 4, the process proceeds to step S511, where it is determined whether the count value of the buffer passage counter is 5 or not. If the count value of the buffer passage counter is 5, the process proceeds to step S519 shown in FIG. 13, where the buffer passage counter is cleared to 0, and in the following step S520, the bundle discharging is designated, followed by terminating the present process. If the count value of the buffer passage counter is not 5, the present process is terminated.

In the step S514, it is determined whether the operation mode is the sort mode or not, and if the operation mode is not the sort mode, that is, if the operation mode is the staple sort mode, the present process is terminated. If the operation mode is the sort mode, the process proceeds to step S515, where it is determined whether the count value of the buffer passage counter is 3 or not. If this value is not 3, the present process is terminated. If the count value of the buffer passage counter is 3, the process proceeds to step S519 shown in FIG. 13, where the buffer passage counter is cleared to 0, and in the following step S520, the bundle discharging is designated, followed by terminating the present process.

If in the step S503 it is determined that the sheet is the last sheet of a bundle, the process proceeds to step S516 shown in FIG. 13, where the aligning position information is discriminated. If the aligning position information indicates an aligning position A, the process proceeds to step S517, where the aligning position information is set to an aligning position B. If the aligning position information indicates the aligning position B, the process proceeds to step S518, where the aligning position information is set to the aligning position A. The set aligning position information determines the set offset direction of the sheets on the processing tray 630. That is, the aligning position information indicating the offset direction at the time this processing is performed is set as information indicative of alignment offset of the sheet. The aligning position information indicating the offset direction is thus reversed by the last sheet, so as to realize an offset or displaced stacking of sheets on the processing tray 630.

When the setting of the aligning position information has been completed, the process proceeds to step S519, where the buffer passage counter is cleared to 0, and in the following step S520, the bundle discharging is designated, followed by terminating the present process.

The designation of the bundle discharging in the step S520 means that when the sheets are discharged onto and stacked on the processing tray 630, an action of bundle discharging from the processing tray 630 to the stack tray 700 is started, and this bundle discharging designation is used in the bundle discharging action determining process to be described later.

Figure 16:
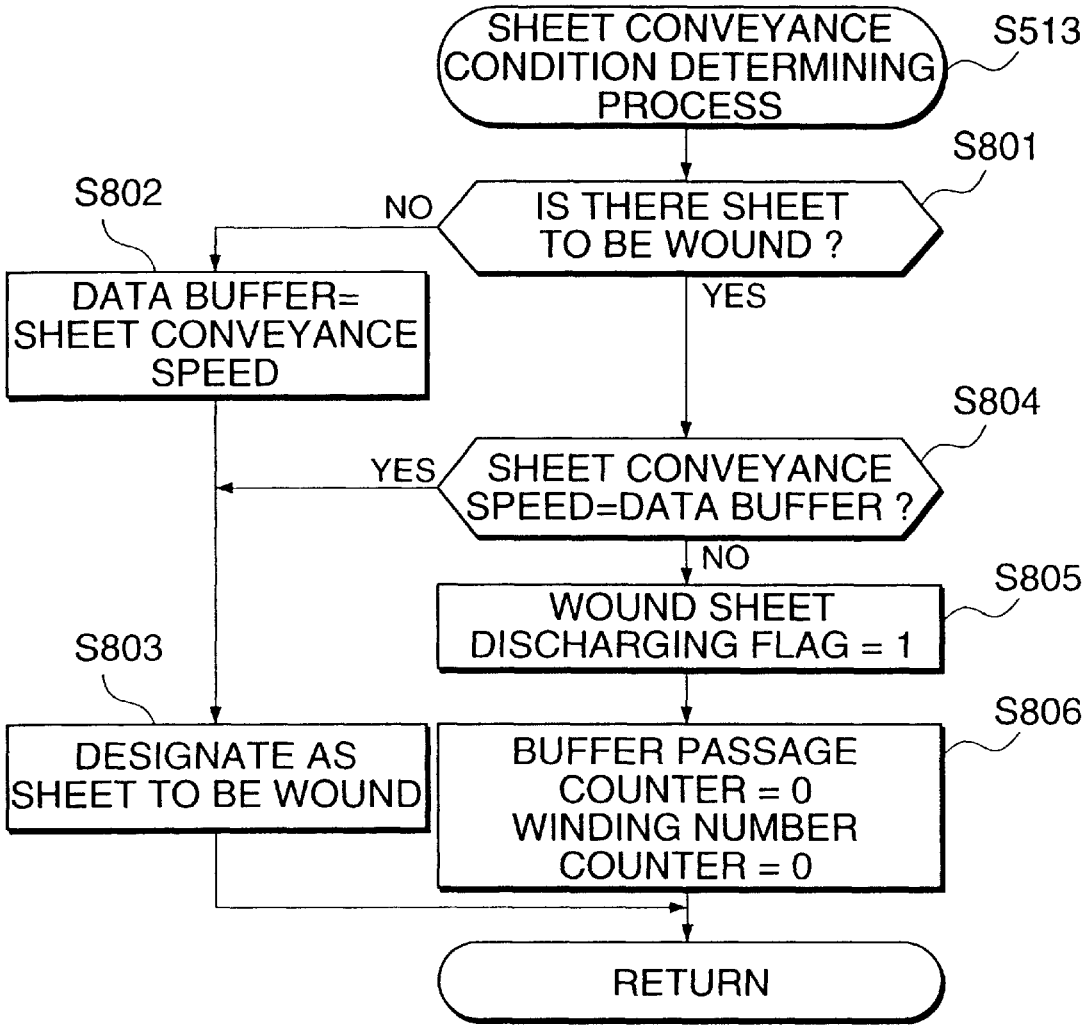
FIG. 16 is a flow chart showing a sheet conveyance condition determining process executed in a step S513 of FIG. 12.

Next, the sheet conveyance condition determining process will be described with reference to FIG. 16. FIG. 16 is a flow chart showing the sheet conveyance condition determining process executed in step S513 of FIG. 12.

In the sheet conveyance condition determining process, first, in step S801, it is determined whether there is any preceding sheet that is set as a sheet to be wound or not. In the present embodiment, this determination is performed to discriminate the identity of the sheet conveyance condition between a plurality of sheets to be wound. If there is no preceding sheet set to be wound, the process proceeds to step S802, where the sheet conveyance speed is set in a data buffer. In the following step S803, the sheet is designated as the first sheet to be wound.

On the other hand, if there is any preceding sheet set to be wound, the process proceeds to step S804, where the difference of the sheet conveyance condition from the condition set for the preceding sheet to be wound is determined. Here, it is determined whether the sheet conveyance speed stored in the data buffer is the same as the sheet conveyance speed for the present sheet or not. If it is determined in the affirmative, the process proceeds to the above-mentioned step S803, where the sheet is designated as a sheet to be wound. If the sheet conveyance speed stored in the data buffer is not the same as the sheet conveyance speed for the present sheet, the process proceeds to step S805, where the wound sheet discharging flag is set to instruct discharging of the preceding wound sheet from the buffer roller, and in the following step S806, data concerning the winding are reset, that is, the buffer passage counter is reset to 0, and the winding number counter is reset to 0, to inhibit any winding operation until the condition that permits sheets to be wound is set, followed by terminating the present process.

In the present embodiment, the sheet conveyance speed is set as the sheet conveyance condition. This is because the conveyance of a plurality of sheets at different conveyance speeds gives rise to an undesirable situation in the conveyance of sheets and alignment of sheets on the processing tray 630.

This completes the determining and setting operations regarding the attribute of sheets (whether a winding operation should be performed, and whether a bundle discharging should be performed).

Figure 14:
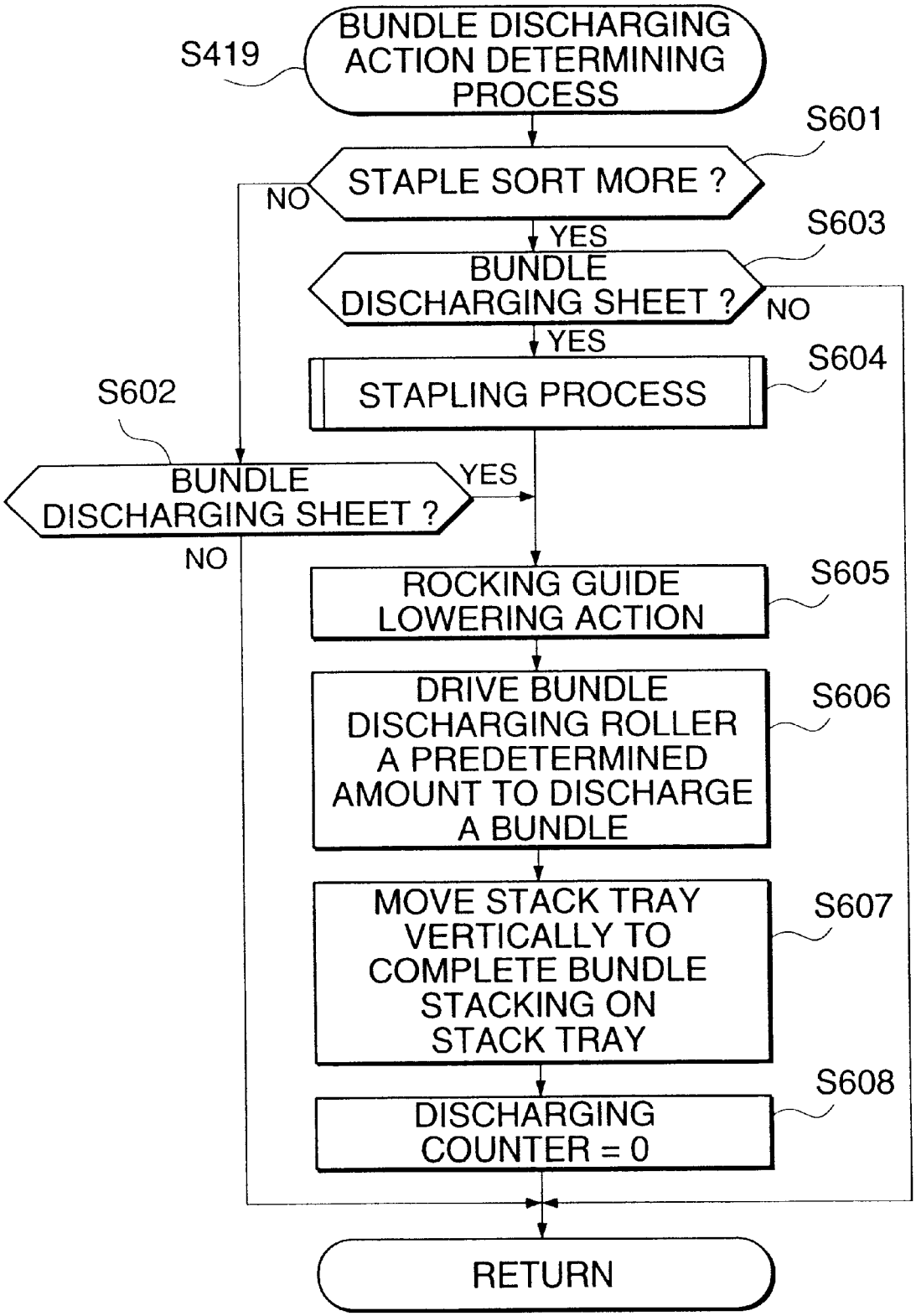
FIG. 14 is a flow chart showing a bundle discharging action determining process executed in a step S419 of FIG. 11.

Next, the bundle discharging action determining process will be described with reference to FIG. 14. FIG. 14 is a flow chart showing the bundle discharging action determining process executed in step S419 of FIG. 11.

When, in the sort sheet sequence described above, the process proceeds to the bundle discharging action determining process, first, in step S601 it is determined whether the operation mode is the stapling mode or not. If the operation mode is not the stapling mode, the process proceeds to step S602, where it is determined whether the sheet discharged onto the processing tray 630 is a bundle discharging sheet or not. If it is not a bundle discharging sheet, the present process is terminated and the process returns to the above-mentioned sort sheet sequence.

If in the step S602 it is determined that the sheet discharged onto the processing tray 630 is a bundle discharging sheet, the process proceeds to step S605, where a rocking guide is operated to bring a bundle discharging upper roller into abutment with the sheet bundle on the processing tray 630. The process proceeds to step S606, where after waiting for the bundle discharging upper roller to cease bouncing, the bundle discharging upper roller is driven a predetermined amount while controlling the speed of the bundle discharging motor to thereby discharge the sheet bundle from the processing tray 630 onto the stack tray 700.

Then, the process proceeds to step S607, where the stack tray 700 is moved vertically to complete the action of stacking the bundle onto the stack tray 700. In the following step S608, the discharging counter is reset to 0, followed by terminating the present process.

If in the above step S601 it is determined that the operation mode is the stapling mode, the process proceeds to step S603, where it is determined whether the sheet discharged onto the processing tray 630 is a bundle discharging sheet or not. If it is not a bundle discharging sheet, the present process is terminated, and returns to the above-mentioned sort sheet sequence operation. If the sheet discharged onto the processing tray 630 is a bundle discharging sheet, the process proceeds to step S604, where the stapling process is executed. Then, the process proceeds to step S605 to perform the lowering action of the rocking guide, and performs the above-described bundle discharging action (steps S606 to S608), followed by terminating the present process.

Figure 15:
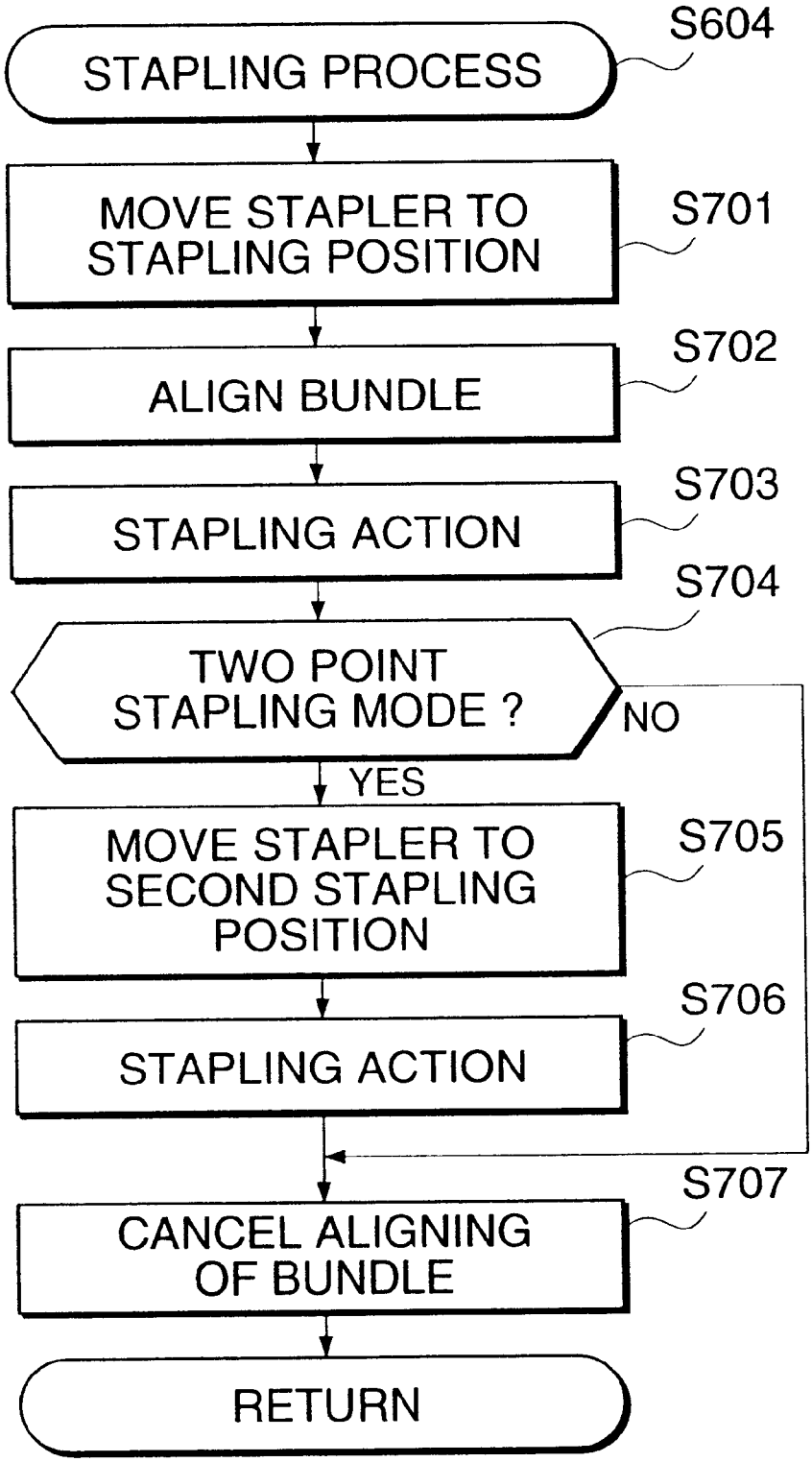
FIG. 15 is a flow chart showing a stapling process executed in a step S604 of FIG. 14.

Next, the stapling process will be described with reference to FIG. 15. FIG. 15 is a flow chart showing the stapling process executed in step S604 of FIG. 14.

In the stapling process mode, first, in step S701, the stapler 601 is moved a predetermined amount to the stapling position. Then, in the following step S702, a bundle on the processing tray 630 is aligned using an aligning means 640 consisting of a near-side aligning member and an off-side aligning member, and in step S703 a stapling action is performed.

Next, in step S704, it is determined whether the operation mode is a two-point stapling mode or not. If the operation mode is not the two-point stapling mode, the process proceeds to step S707, where the aligning of the bundle using the aligning means 640 consisting of the near-side aligning member and the off-side aligning member is canceled, followed by terminating the present process.

If in the step S704 it is determined that the operation mode is the two-point stapling mode, the process proceeds to step S705, where the stapler 601 is moved a predetermined amount to a second stapling position. In the following step S706, a stapling action at the second position is performed, and in step S707 the aligning of the bundle using the aligning means 640 consisting of the near-side aligning member and the off-side aligning member is canceled, followed by terminating the present process.

Figure 18:
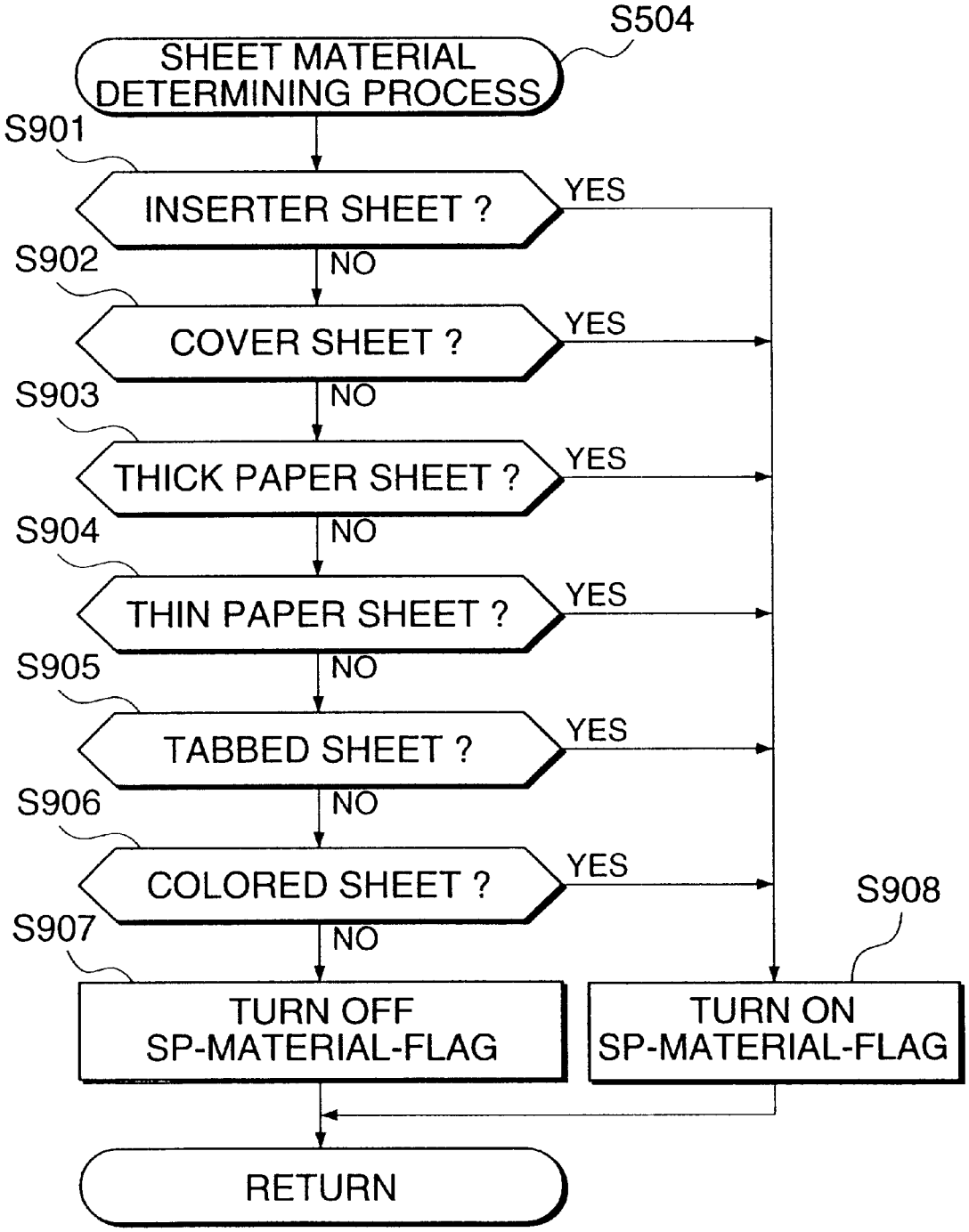
FIG. 18 is a flow chart showing a sheet material determining process executed in a step S505 of FIG. 12.

Next, the sheet material determining process will be described with reference to FIG. 18. FIG. 18 is a flow chart showing the sheet material determining process executed in step S505 of FIG. 12.

In this operation, pre-processing is performed to determine according to the material (type of the sheet) whether the winding operation on the sheet is inhibited or not.

First, in steps S901, S902, S903, S904, S905, and S906, it is determined whether the sheet is any one of an inserter sheet, a cover sheet, a thick paper sheet, a thin paper sheet, a tabbed sheet, or a colored sheet, respectively. If the sheet is an inserter sheet, a cover sheet, a thick paper sheet, a thin paper sheet, a tabbed sheet, or a colored sheet, the process proceeds to step S908 to turn on the sp_material_flag (special material flag), followed by terminating the present process. Thus, the controller (CPU circuit unit 150) inhibits the sheet staying operation for staying a sheet by using the buffer roller 505, as mentioned above.

If the sheet (for example, an ordinary recording sheet) is none of an inserter sheet, a cover sheet, a thick paper sheet, a thin paper sheet, a tabbed sheet, or a colored sheet, the process proceeds to step S907 to turn off the sp_material_flag (special material flag), followed by terminating the present process. Thus, the controller (CPU circuit unit 150) permits the sheet staying operation for staying a sheet by using the buffer roller 505, as mentioned above.

As described above, according to the present embodiment, when the conveyed sheet is a special sheet, winding of the sheet on the buffer roller is inhibited. Thus, even when special sheets having attributes different from those of ordinary sheets are conveyed for post-processing together with ordinary sheets, occurrence of a sheet jam or damage to special sheets caused by winding (halting or staying) of these special sheets can be avoided so that high quality post-processing can be achieved.

The above-mentioned "inserter sheet" means a special sheet that is fed from the inserter tray 901 with images formed thereon beforehand, as described before with reference to FIG. 5. The inserter sheet is used as a cover sheet or the like for a group of sheets from the image forming apparatus, and is conveyed without passing through the main body of the image forming apparatus and processed on the tray 700 or the like together with sheets from the image forming apparatus. The "thick paper sheet" is a special sheet that is used as a cover sheet or an interleaved sheet for book-binding, and is thicker and stronger than ordinary sheets (an OHP sheet is also included in this category). The "colored sheet" is a special sheet that is colored, and is used, for example, to clearly distinguish Chapter 1 from Chapter 2 in book-binding, or the like. The "thin paper sheet" is a special sheet that is thinner and weaker than ordinary sheets, and is used as a sheet for design drawings or the like. The "tabbed sheet" is a special sheet that has tabs (tab portion) integrally formed thereon.

In the present embodiment, as described above, when conveying sheets from an upstream side (for example, the main body of the image forming apparatus or the inserter 900) via the buffer roller 505 toward a predetermined unit on a downstream side (for example, the tray 630, the tray 701 or another stacking unit determined as set by an operator), if the sheet to be conveyed toward the above predetermined unit is an ordinary recording sheet (ordinary sheet), the sheet winding operation by the buffer roller 505 is performed so that the sheet is temporarily stayed on the buffer roller 505 and the feeding of the sheet toward the above predetermined unit is temporarily inhibited.

The above described sheet staying control operation (sheet staying control operation) is performed only when another group of sheets different from the group of the sheet to be conveyed to the above predetermined unit (a copy of a book is also regarded as another group) already exists on the predetermined unit (for example, the processing tray 630). Further, in the present embodiment, when a predetermined number of sheets have been wound on the buffer roller 505, the sheet staying control operation is canceled and the conveyance of sheets toward the above predetermined unit is resumed. The predetermined number is determined in terms of, for example, a time required for another group of sheets existing on the above predetermined unit to be discharged to a different unit (for example, the tray 700) until no sheet of this other group is left on the predetermined unit. Therefore, the restart of conveyance of sheets on the buffer roller 505 may be controlled such that the conveyance is resumed, as in the present embodiment, when the number of sheets wound on the buffer roller 505 has reached the predetermined number. Alternatively, it may be controlled such that even if the number of sheets on the buffer roller 505 has not reached the predetermined number (that is, irrespective of whether the predetermined number has been reached or not), the conveyance of sheets on the buffer roller 505 toward the predetermined unit is resumed upon confirmation using a sensor (not shown) or the like that there is no sheet left on the above predetermined unit.

On the other hand, if the sheet to be conveyed toward the above predetermined unit is of a different type (attributes) from an ordinary recording sheet, the above described sheet winding and staying operation (sheet staying operation) by the buffer roller 505 is inhibited and the sheet is conveyed directly toward the above predetermined unit without being halted (stayed) temporarily on the buffer roller 505.

Thus, in the present embodiment, the CPU (not shown) mounted on the CPU circuit block 150 determines according to the type (attributes) of the sheet to be conveyed toward the predetermined unit whether the operation of temporarily staying the sheet on the buffer roller 505 by the sheet winding action by the buffer roller 505 and temporarily inhibiting the conveyance of the sheet toward the above predetermined unit should be executed or not. This control may be executed for each sheet (each page) to be conveyed or for a plurality of sheets (for each group).

In the present embodiment, "inserter sheet", "cover sheet", "thick paper sheet", "thin paper sheet", "tabbed sheet", and "colored sheet" are referred to as examples of special sheets that differ in kind or type from ordinary recording sheets. However, the special sheets are not limited to these sheets, and the sheet processing apparatus can be controlled such that any sheet which may degrade in quality or give rise to a sheet jam due to the sheet winding action by the buffer roller 505 is regarded as a special sheet and is not stayed on the buffer roller 505. In this case, those types of sheets which may give rise to the above-mentioned problem may be designated and registered beforehand as special sheets other than ordinary recording sheets from the operation part by an operator, so that upon request to start image formation from the operator, it is controlled based on the above designation of sheets such that the sheet is not stayed on the buffer roller 505.

There are various ways for the CPU (not shown) of the CPU circuit block 150 to obtain (discriminate) information on the kind (type) of sheets to be conveyed. For example, the operator may set the kind (type) of sheets for each sheet-feed cassette via the operation part or the like, and store information on the types of sheets set for respective sheet-feed cassettes in a memory such as the RAM 152 in a manner being discriminatable from each other, so that in actual image forming operation the information on the sheet to be conveyed can be obtained from the above stored information based on the sheet-feed cassette that is then selected. Alternatively, when the operator enters a command for executing image formation through a display screen of the operation part, he may input, in addition to the command, an instruction to specify the type of sheets to be conveyed, so that the CPU can obtain the information on the type of sheets based on the input operation by the operator. Also alternatively, the type of sheets may be automatically discriminated using sensors. For example, reflection type optical sensors or the like may be provided at respective sheet-feed ports to determine the types of sheets according to values of according to the reflectivity detected by the sensors. Further, information concerning the size of sheets may be obtained from information input by the operator via the operation part, or may be obtained by size detection by means of a sensor.

The number of sheets that can to be wound on the buffer roller 505 may be one, or it may be more than one in terms of productivity, as in the present embodiment.

In the present embodiment, winding of special sheets on the buffer roller 505 is inhibited. However, special sheets and ordinary sheets may be wound together on the buffer roller, but the number of sheets to be wound on the buffer roller 505 is limited, providing substantially the same results as above.

In temporarily staying sheets by winding the sheets on the buffer roller 505 as in the present embodiment, the number of sheets to be stayed may be controlled by the CPU (not shown) of the CPU circuit block 150 so as to differ according to the type of sheets.

For example, according to the kind (type) of sheets to be conveyed toward the predetermined unit (the processing tray 630 or the tray 701), the number of sheets to be stayed on the buffer roller 505 may be controlled such that when the sheets to be conveyed are ordinary recording sheets, the number of sheets to be stayed is three (or, up to three sheets may be permitted to be stayed on the buffer roller 505), when the sheets to be conveyed are colored sheets, the number of sheets to be stayed on the buffer roller 505 is two (or, up to two sheets may be permitted to be stayed on the buffer roller 505), when the sheets to be conveyed are tabbed sheets or inserter sheets, the number of sheets to be stayed on the buffer roller 505 is one (or, only one sheet may be permitted to be stayed on the buffer roller 505), and when the sheets to be conveyed are OHP sheets, thick paper sheets, or thin paper sheets, the number of sheets to be stayed on the buffer roller 505 is 0, that is, staying of these sheets on the buffer roller 505 is inhibited.

In the case of ordinary recording sheets, for example, conveyance of the sheets toward the above predetermined unit may be resumed when three sheets have been wound on the buffer roller 505. In the case of colored sheets, conveyance of the sheets toward the above predetermined unit may be resumed when two sheets have been wound on the buffer roller 505. In the case of tabbed sheets or inserter sheets, conveyance of the sheets toward the above predetermined unit may be resumed when one sheet has been wound on the buffer roller 505. In the case of OHP sheets, thick paper sheets, or thin paper sheets, sheets are not stayed on the buffer roller 505, and may be conveyed directly to the above predetermined tray.

In the present embodiment, programs to execute various processing operations (including operations shown by the flow charts of FIGS. 6 through 18) are stored as program codes in the ROM 151 of the CPU circuit block 150, and the CPU (not shown) in the CPU circuit block 150 reads out the codes to execute the functions. It is to be understood that the present invention may also be realized by supplying a system or an apparatus with a storage medium in which the program code of software that realizes the function of the present embodiment is recorded, and causing a computer (or CPU, MPU) of the system or apparatus to read out and execute the program code stored in the storage medium.

In this case, the program code itself read out from the storage medium realizes the above described functions of the present embodiment, so that the storage medium storing the program code also constitutes the present invention.

The storage medium for supplying the program code may be selected from, for example, a floppy disk, hard disk, optical disk, magneto-optical disk, CD-ROM, CD-R, magnetic tape, non-volatile memory, and ROM.

It is to be understood that the functions of the above described embodiment may be accomplished not only by executing a program code read out by a computer, but also by causing an operating system (OS) that operates on the computer to perform a part or the whole of the actual operations according to instructions of the program code.

Furthermore, the program code read out from the storage medium may be written into a memory provided in an expanded board inserted in the computer, or an expanded unit connected to the computer, and a CPU or the like provided in the expanded board or expanded unit may actually perform a part or all of the operations according to the instructions of the program code, so as to accomplish the functions of the above described embodiment.

As described above, according to the present invention, it is possible to realize high quality processing while maintaining high productivity without giving rise to problems such as a sheet jam or damage of sheets even when various sheets of different attributes are conveyed.

What is claimed is:

1. A sheet processing apparatus comprising:

a conveyance path;

a discharging port;

conveyance means for conveying sheets along said conveyance path to said discharging port;

sheet staying means for temporarily maintaining said sheets in a looped path;

sheet type determining means for determining whether or not each of said sheets conveyed by said conveyance means is suitable for being maintained in said looped path; and sheet staying number limiting means for limiting a number of sheets to be maintained by said sheet staying means when each of the sheets conveyed by said conveyance means is not suitable for being maintained in said looped path.

2. A sheet processing apparatus according to claim 1, further comprising sheet staying number detecting means for detecting a number of sheets maintained in said looped path by said sheet staying means, and wherein said sheet staying number limiting means comprises determining means for determining, based on detection results of said sheet staying number detecting means, whether or not the number of sheets maintained in said looped path by said sheet staying means has reached a predetermined number that is set in advance in correspondence with whether or not each of said sheets conveyed by said conveyance means is suitable for being maintained in said looped path, and control means for resuming conveyance of said sheets maintained in said looped path by said sheet staying means with said conveyance means when the number of sheets maintained in said looped path by said sheet staying means has reached said predetermined number.

3. A sheet processing apparatus according to claim 1, wherein when each of the sheets conveyed by said conveyance means is not suitable for being maintained in said looped path, said sheet staying number limiting means inhibits said sheet staying means from maintaining the sheets conveyed by said conveyance means in said looped path.

4. A sheet processing apparatus according to claim 1, further comprising sheet staying number detecting means for detecting the number of sheets maintained in said looped path by said sheet staying means, and wherein said sheet staying number limiting means comprises determining means for determining based on detection results of said sheet staying number detecting means whether or not the number of sheets maintained in said looped path by said sheet staying means has reached a maximum number that is set in advance in correspondence with an ordinary sheet, and control means for resuming conveyance of said sheets maintained in said looped path by said sheet staying means with said conveyance means when the number of sheets maintained in said looped path by said sheet staying means has reached said maximum number.

5. A sheet processing apparatus according to claim 2 or 4, further comprising sheet position detecting means for detecting a position of each of the sheets in said looped path, and wherein said control means temporarily maintains said conveyance means on standby to suspend conveyance of said sheets maintained in said looped path by said sheet staying means when said sheet position detecting means detects presence of at least one sheet downstream of said sheet staying means.

6. A sheet processing apparatus according to claim 1, wherein each of said sheets conveyed by said conveyance means, which is not suitable for being maintained in said looped path, is a sheet selected from the group consisting of a sheet from a set tray, a sheet designated as a cover sheet, a sheet designated as a thick paper sheet, a sheet designated as a thin paper sheet, a tabbed sheet, and a colored sheet.

7. A sheet processing apparatus which conveys a sheet from an upstream side to a downstream side of the apparatus, comprising:

sheet staying means for maintaining the sheet conveyed from said upstream side in a looped path;

sheet type determining means for determining a type of sheet from said upstream side, to be conveyed to said downstream side via said sheet staying means; and control means for controlling said sheet staying means to inhibit said sheet staying means from maintaining the sheet from said upstream side in a looped path based on the type of sheet determined by said sheet type determining means.

8. An apparatus according to claim 7, wherein said control means controls said sheet staying means so that the sheet conveyed from said upstream side is conveyed to said downstream side via said sheet staying means, without said sheet staying means maintaining the sheet from said upstream in said looped path, when the type of sheer from said upstream side is nor suitable for being maintained in said looped path.

9. An apparatus according to claim 8, wherein the sheet from said upstream side includes an ordinary recording sheet, and a special recording sheet different in type from said ordinary recording sheet, and wherein said control means controls said sheet slaying means to maintain the sheet from said upstream side, to be conveyed to said downstream side, in said looped path if that sheet is said ordinary recording sheet, and controls to inhibit said sheet staying means from maintaining the sheet from said upstream side, to be conveyed to said downstream side, in said looped path it that sheet is said special recording sheet different in type from said ordinary recording sheet.

10. An apparatus according to claim 9, wherein said special recording sheet includes at least one of a cover sheet, a tabbed sheet, a thick paper sheet, a thin paper sheet, a colored sheet, and a sheet fed from an inserter.

11. An apparatus according to claim 7, wherein said sheet staying means includes a roller adapted for having at least one sheet wound thereon.

12. An apparatus according to claim 11, wherein said roller is adapted for having a plurality of sheets wound thereon.

13. An apparatus according to claim 12, wherein said roller is adapted for having said plurality of sheets wound thereon with each sheet being displaced from a preceding one in a direction of conveyance of the sheets.

14. An apparatus according to claim 7, wherein said sheet staying means conveys the sheet from said upstream to said downstream side toward a loading means arranged on said downstream side for loading the sheets therein.

15. An apparatus according to claim 14, wherein said control means controls said sheet staying means to maintain the sheet from said upstream side in said looped path if a sheet different in group from the sheet from said upstream side is already loaded in said loading means.

16. An apparatus according to claim 15, wherein said control means controls said sheet staying means to maintain the sheet from said upstream side in said looped path until said sheet different in group from the sheet from said upstream side already loaded in said loading means is removed from said loading means, and to resume conveyance of the sheet maintained in said looped path by said sheet staying means to said downstream side when said sheet different in group from the sheet from said upstream side has been removed from said loading means.

17. An apparatus according to claim 14, wherein said control means controls to inhibit said sheet staying means from maintaining the sheet from said upstream side in said looped path regardless of the type of the sheer from said upstream side, if a sheet different in group from the sheet from said upstream side is not loaded in said loading means.

18. An apparatus according to claim 7, wherein said sheer staying means is adapted to maintain a plurality of sheets in said looped path, and wherein said control means controls to resume conveyance of the sheets maintained in said looped path by said sheet slaying means to said downstream side based on a number of the sheets maintained in said looped path by said sheet staying means.

19. A sheet processing apparatus which conveys sheets from an upstream side to a downstream side of the apparatus, comprising:

sheet staying means for maintaining the sheet conveyed from said upstream side in a looped path;

sheet type determining means for determining a type of sheet from said upstream side, to be conveyed to said downstream side via said sheet staying means; and control means for controlling a number of sheets to be maintained in said looped path by said sheet staying means when the type of sheet determined by said sheet type determining means is not suitable for being maintained in said looped path.

20. An apparatus according to claim 19, wherein the sheets from said upstream side include an ordinary recording sheet, and a special recording sheet different in type from said ordinary recording sheet, and wherein said control means controls the number of said special recording sheet to be maintained in said looped path by said sheet staying means to a number less than the number of said ordinary recording sheet to be maintained in said looped path.

21. A sheet processing apparatus which conveys a sheet from an upstream side to a downstream side of the apparatus, comprising:

a sheet staying unit for maintaining the sheet conveyed from said upstream side in a looped path;

a sheet type determining unit for determining a type of sheet from said upstream side, to be conveyed to said downstream side via said sheet staying unit; and a controller for controlling said sheet staying unit to inhibit said sheet staying unit from maintaining the sheet from said upstream side in said looped path when the type determined by said sheet type determining unit is not suitable for being maintained in said looped path.

22. A sheet precessing apparatus which conveys sheet from an upstream side to a downstream side of the apparatus, comprising:

a sheet staying unit for maintaining the sheet conveyed from said upstream side in a looped path;

a sheet type determining unit for determining a type of sheet from said upstream side, to be conveyed to said downstream side via said sheet staying unit; and a controller for controlling a number of sheets to be maintained in said looped path by said sheet staying unit when the type determined by said sheet type determining unit is not suitable for being maintained in said looped path.

* * * * *